US008241183B2

(12) United States Patent
Hautoplund

(10) Patent No.: US 8,241,183 B2
(45) Date of Patent: Aug. 14, 2012

(54) MODULAR ROBOTIC TILES FOR PHYSICAL INTERACTION

(75) Inventor: Henrik Hautoplund, Odense M (DK)

(73) Assignee: Entertainment Robotics/H. H. Lund, Odense M (DK)

( * ) Notice: Subject to any disclaimer, the term of this patent is extended or adjusted under 35 U.S.C. 154(b) by 87 days.

(21) Appl. No.: 12/450,665

(22) PCT Filed: Mar. 26, 2009

(86) PCT No.: PCT/DK2009/000072
§ 371 (c)(1),
(2), (4) Date: Oct. 5, 2009

(87) PCT Pub. No.: WO2009/118008
PCT Pub. Date: Oct. 1, 2009

(65) Prior Publication Data

US 2010/0105526 A1 Apr. 29, 2010

(30) Foreign Application Priority Data

Mar. 26, 2008 (EP) ..... 08388012

(51) Int. Cl.
*A63B 71/00* (2006.01)

(52) U.S. Cl. ..... 482/8

(58) Field of Classification Search ..... 482/9; 273/237
See application file for complete search history.

(56) References Cited

U.S. PATENT DOCUMENTS

| | | | | |
|---|---|---|---|---|
| 6,227,968 | B1 * | 5/2001 | Suzuki et al. | 463/7 |
| 2005/0116667 | A1 * | 6/2005 | Mueller et al. | 315/312 |

FOREIGN PATENT DOCUMENTS

| | | | |
|---|---|---|---|
| FR | 2847174 | | 5/2004 |
| WO | 9632164 | | 10/1996 |
| WO | WO 01/08755 | * | 5/2000 |
| WO | WO 0108755 | * | 5/2000 |
| WO | 0108755 | | 2/2001 |
| WO | 03084618 | | 10/2003 |

* cited by examiner

*Primary Examiner* — LoAn H. Thanh
*Assistant Examiner* — Shila Jalalzadeh Abyane
(74) *Attorney, Agent, or Firm* — Jacobson Holman PLLC

(57) ABSTRACT

A therapeutic training device includes a shallow housing of a specific shape with a quadratic top surface, a quadratic bottom surface and four thin rectangular side surfaces. The housing includes an upwardly open cavity in the top surface and a flexible and transparent cover which encloses the cavity at least partially. The flexible and transparent cover has a size in the range between the size of a human fist and the size of a human foot, and defines a central part. The housing further includes a force sensor placed inside the cavity communicating with the central part. The force sensor measures the force applied on the flexible and transparent cover and generates a response signal. The housing further includes a light source placed inside the cavity, the light source being visible through the flexible and transparent cover, and a central processor placed inside the housing, which activates the light sources in accordance with a specific software and evaluates the response signal from the force sensor in accordance with the specific software. A plurality of communication devices are located on the side surfaces and is controlled by the central processor and communicates with adjacent devices.

1 Claim, 24 Drawing Sheets

| Item # | Quantity | Designator | Description | Footprint | Comment |
|---|---|---|---|---|---|
| 1 | 1 | A1 | 2 axis accelerometer, 5G | 16 LD LFCSP 4x4mm | ADXL320 |
| 2 | 3 | BT1, BT2, BT3 | Multicell Battery | Battery clip | NIMH AA |
| 3 | 4 | C1, C2, C48, C49 | Capacitor | c0805 | 10uF |
| 4 | 4 | C4, C15, C20, C26 | Capacitor | C0805 | 10nF |
| 5 | 9 | C5, C7, C8, C16, C18, C21, C23, C27, C29 | Capacitor | C0805 | 100nF |
| 6 | 8 | C6, C14, C17, C19, C22, C24, C28, C30 | Capacitor | C0805 | 4.7uF |
| 7 | 8 | C9, C10, C11, C12, C13, C25, C50, C51 | Capacitor | C0805 | 0.22uF |
| 8 | 2 | C31, C32 | Capacitor | C0805 | 18pF |
| 9 | 2 | C33, C36 | Capacitor | 1608[0603] | 0p5 |
| 10 | 2 | C34, C35 | Capacitor | 1608[0603] | 5p6 |
| 11 | 4 | C37, C39, C40, C45 | Capacitor | 1608[0603] | 100nF |
| 12 | 4 | C38, C41, C42, C43 | Capacitor | 1608[0603] | 68pF |
| 13 | 1 | C44 | Capacitor | 1608[0603] | 10nF |
| 14 | 2 | C46, C47 | Capacitor | 1608[0603] | 27pF |
| 15 | 2 | C52, C53 | Capacitor | C0805 | 0.10uF |
| 16 | 4 | Encoder 0, Encoder 1, Encoder 2, Encoder 3 | | SO8 | MCP2122 |
| 17 | 1 | JP1 | Header, 10-Pin | IDC2.54-V10D | JTAG |
| 18 | 1 | JP2 | Header, 14-Pin | IDC2.54-V14D | Display |
| 19 | 1 | JP3 | Header, 14-Pin | IDC2.54-V14D | AUX EXT |
| 20 | 1 | JP4 | Header, 4-Pin | HDR1X4 | I2C EXT |
| 21 | 1 | JP5 | Header, 4-Pin | XBee | XBEE |
| 22 | 1 | L1 | Inductor | 3216[1206] | 10uH |
| 23 | 1 | L2 | Inductor | 2012[0805] | 7n5 |
| 24 | 1 | L3 | Inductor | L0603 | 5n6 |
| 25 | 1 | L4 | Inductor | L0603 | 7n5 |
| 26 | 8 | LED1-1, LED1-2, LED2-1, LED2-2, LED3-1, LED3-2, LED4-1, LED4-2 | LED SMD 1206 | LED_SMD 1206 | RGB LED |

Fig 10a1

| | | | | | |
|---|---|---|---|---|---|
| 27 | 1 | P1 | Header, 3-Pin | HDR1X3 | Charge Plug |
| 28 | 1 | P2 | Header, 2-Pin | HDR1X2 | FSR |
| 29 | 1 | PCB Antenna | Generic Antenna | Inverted-F Antenna | |
| 30 | 2 | R1, R2 | Resistor | 2012[0805] | 100K |
| 31 | 4 | R3, R7, R16, R26 | Resistor | 2012[0805] | 47R |
| 32 | 1 | R4 | Resistor | 2012[0805] | 10K |
| 33 | 1 | R5 | Resistor | 2012[0805] | NUL |
| 34 | 4 | R6, R11, R22, R30 | Resistor | 2012[0805] | 2K7 |
| 35 | 7 | R8, R12, R15, R19, R23, R27, R31 | Resistor | 2012[0805] | 5R1 |
| 36 | 8 | R9, R13, R17, R20, R24, R28, R32, R37 | Resistor | 2012[0805] | 2R4 |
| 37 | 8 | R10, R14, R18, R21, R25, R29, R33, R38 | Resistor | 2012[0805] | 62R |
| 38 | 2 | R34, R35 | Resistor | 2012[0805] | 4K7 |
| 39 | 1 | R36 | Resistor | 2012[0805] | 100nF |
| 40 | 1 | R39 | Resistor | J1-0603 | 43K |
| 41 | 1 | R40 | Resistor | J1-0603 | 2R |
| 42 | 4 | Transceiver 0, Transceiver 1, Transceiver 2, Transceiver 3 | | TFDU4300 | TFDU4300 |
| 43 | 1 | U1 | 500mA Linear Regulator | DIP-8 | MAX604 |
| 44 | 1 | U3 | Atmel | F-QFP14x14-G100/X.3N | ATmega1280 |
| 45 | 2 | U4, U5 | LED driver | SSO-G24/X.4 | |
| 46 | 1 | U6 | | QLP48 | CC2420 |
| 47 | 1 | Y1 | Crystal Oscillator | XTAL - duplicate | 4MHz |
| 48 | 1 | Y2 | Crystal Oscillator | XTAL - duplicate | 16MHz |

Fig 10a2

| Item # | Quantity | Designator | Description | Footprint | Comment |
|---|---|---|---|---|---|
| 1 | 4 | C1, C2, C3, C6 | Capacitor | 2012[0805] | 10uF |
| 2 | 2 | C4, C5 | Capacitor | 2012[0805] | 2,2uF |
| 3 | 1 | D1 | Typical RED GaAs LED | LED-1 | LED1 |
| 4 | 1 | JP1 | Header, 14-Pin | IDC2.54-V14D | Display |
| 5 | 1 | P1 | Header, 2-Pin | HDR1X2 | Header 2 |
| 6 | 8 | R1, R2, R3, R4, R5, R6, R7, R8 | Resistor | 2012[0805] | 10K |
| 7 | 1 | R9 | Resistor | 2012[0805] | 12K |
| 8 | 4 | S1, S2, S3, S4 | Switch | Button | SW-PB |
| 9 | 1 | U1 | High Efficiency charge pump | PWP20 | TPS60130 |
| 10 | 1 | Xbee1 | MaxStream XBee Module | XBEE | MaxStream XBee |

Fig 10b

MODULAR ROBOTIC TILES FOR PHYSICAL INTERACTION

This is a national stage of PCT/DK09/000072 filed on 26 Mar. 2009 and published in English, which has a priority of European Patent Appln. No. 08388012.0 filed 26 Mar. 2008, hereby incorporated by reference.

FIELD OF THE INVENTION

The present invention relates to exercise equipment or training devices allowing the user to perform a specific physical activity aimed to improve for example strength, stamina or agility of the user. The training device may be designed to train certain parts of the body or to improve the general fitness of the user. Training devices range from simple lifting weights, exercise balls and the like to more complex treadmills, exercise bikes and the like.

BACKGROUND OF THE INVENTION

Individuals recovering from a surgery or injury may speed up their recovery by the use of training devices. Such individuals typically need small and light training devices suitable for use in hospital or home environments. Training devices suitable for physical therapy should preferably be flexible, adjustable and work in a controlled manner to be usable for different patient groups needing different training. Depending on the body part in need of training a different training program may be required. Additionally, some patients are in need of frequent rest periods while others may train for a longer time period.

Most training devices provide a rather monotonous training without any intellectual stimulation and tend to bore the user within a few minutes of activity. Additionally, most exercise systems are quite heavy and therefore cannot be moved over a very far distance and provide very little portability.

SUMMARY OF THE INVENTION

It is an object according to the invention to provide a device and a method for indoor physical activity, which gives the user increased intellectual stimulation and thereby motivation during the training exercise. It is a further object of the invention to provide a system, which is both modular and flexible to allow it to be transported and assembled in any location.

The above object together with numerous other objects, advantages and features which will be evident from the below detailed description of the presently preferred embodiments of the invention according to a first aspect of the present invention are according to the teachings of the present invention obtained by a therapeutic training device comprising a shallow housing of a specific shape having a quadratic top surface, a quadratic bottom surface and four thin rectangular side surfaces, the housing comprising: an upwardly open cavity in the top surface, a flexible and transparent cover enclosing the cavity at least partially, the flexible and transparent cover having a size in the range between the size of a human fist and the size of a human foot, and defining a central part, a force sensor placed inside the cavity and communicating with the central part, the force sensor measuring the force applied on the flexible and transparent cover and generating a response signal, a light source placed inside the cavity, the light source being visible through the flexible and transparent cover, a central processor placed inside the housing for activating the light sources in accordance with a specific software and evaluating the response signal from the force sensor in accordance with the specific software, and a plurality of communication means located on the side surfaces controlled by the central processor and communicating with adjacent devices.

A user may interact with the therapeutic training device by applying a hand or a foot onto the flexible and transparent cover and the underlying force sensor. The flexible and transparent cover having a size between a human fist and a human foot should be understood to mean the flexible and transparent cover having a diameter preferably between 5 to 30 cm and most preferably around 15 cm. The flexible and transparent cover may be divided into one flexible but non-transparent part and one transparent but rigid part. The flexible part may preferably be made of a material of sufficient strength and shock resistance to be durable and at the same time the flexible part should be soft not to injure the user. Preferably, a plastic material is used. The light source may be used for giving instructions and information to the user. Alternatively, providing a sound pervious cover, the light source may be substituted with a sound source or a sound source may be used in addition to a light source.

The therapeutical training device is based upon modern artificial intelligence and robotics. It is applicable for different forms of physical activities, for example therapeutic rehabilitation, exercise, physiotherapy, sports, fitness and entertainment. At the same time it gives unique possibilities for documentation of the physical activity for use in for example a therapeutic treatment. It is highly motivating due to immediate feedback and fun, interesting exercises. Several therapeutical training devices may be put together in a therapeutical training system forming an electronic, interactive surface on a floor or wall and each activity or therapeutic treatment may have its own appropriate control program or exercise. The use of the therapeutical training system motivates the user to perform physical activities by providing immediate feedback based upon physical interaction with the system and the user is able to make new physical set-ups within less than a minute.

Processing in electronic devices is traditionally based on central control. This is the case in VCRs, televisions, mobile phones, industrial robots, toy robots, etc. In such cases, the device is controlled by an electronic system with a central control. If just a small part of the central control breaks down, the whole system/device may break down. The invention challenges the traditional central control, and allows processing to be distributed among a number of processing units that can connect together to form a larger, collective system. The individual therapeutical training device includes both processing capabilities and communication capabilities. The therapeutical training system comprising a number of therapeutical training devices allows the user to define the physical shape and the functionality of the therapeutical training system and to interact with the therapeutical training device.

By enumeration of neighbours, the individual therapeutical training device is able to communicate with other specified therapeutical training devices in the system. The detection of neighbours and the overall structure can be done automatically by the system itself at run-time, which facilitates easy modification of the physical form by the user. With neighbour is meant any device adjacent to the side surfaces of the therapeutical training device and communicating with the therapeutical training device. Four neighbours are possible, designated north, south, east and west.

User interaction and capabilities of constructing electronic devices are enhanced by particular processing methods. The invention allows construction of both the physical shape and functionality through the physical construction with no necessary computer skill or need for a personal computer, external programming station, monitor or the like.

Exercises may be run as software on the therapeutical training system. The exercises may adjust themselves to fit any physical configuration constructed by the user. Each exercise may be adjusted to fit particular user groups and levels, such as therapeutic patients, fitness trainees, gamers, etc.

The therapeutical training system may preferably be used for rehabilitation of cardiac patients. For cardiac patients, the exercises on the therapeutical training system may motivate a rise in pulse to appropriate levels. Due to the intellectually stimulating nature of the exercises, the patients find the rehabilitation activity fun and interesting.

Use of the therapeutical training system is not limited to certain patient groups. For instance, exercises that demand the correct movement of the knee and the correct force exerted onto the force sensor will be suitable for knee operated patients. For hip patients the exercises may include walking paths that demand the appropriate weight and force applied on each of the therapeutical training devices, for elderly exercises that stimulate balance training, etc.

Additionally, the therapeutical training system may be used for cognitive rehabilitation. Cognitive tasks may be implemented on the therapeutical training system and feedback (light & sound) may be given to the user based upon the performance of the user on the cognitive tasks. Users may be challenged with different cognitive exercises and the exercises may be easily adjustable to the different capabilities of different users. This may for example be imitation exercise for autistic children.

Further, the therapeutical training system may be used for fitness training and sports training. For example, the therapeutical training system can be set up for precision shooting in football or handball training. Exercises may provide light patterns of different velocity with the purpose of the sport trainee to hit the light and receive feedback (light & sound) from the therapeutical training system when doing so, e.g. to obtain an overall score. Fitness training is often a repetitive and individual activity. The therapeutical training system provides fitness training in the form of fun and challenging exercises that adapt the training level according to the capability of the trainee.

Additionally, the exercises may be of social type by allowing a plurality of users to compete against each other in different exercises on a single therapeutical training system. Hence, the therapeutical training system may be used for individual training by a single user or for simultaneous training by a group of users. Exercises may be designed to allow rehabilitation activities to be performed by a plurality e.g. two, three or four patients at the same time. In this way the rehabilitation exercise may become a competitive exercise between patients. Other user groups such as e.g. fitness trainees, sports trainees, etc. may also use the social type exercises. In activities such as physiotherapy and fitness training the invention provides a unique opportunity for such social activities and challenges for instance in therapeutic rehabilitation practices. With other tools used for such training sessions such social use is often lacking and/or impossible.

Additionally, the therapeutical training system may be used to define musical expressions for music composition and live music performances. For instance, the physical interaction may control different MIDI sequences and thereby, for instance, allow music composers to play music on the therapeutical training system or allow a music concert audience to participate in live music concerts by interacting with the therapeutical training system or allow home users to interact with music albums.

The therapeutical training system may be easily set up on the floor or wall within one minute. The therapeutical training devices may simply attach to each other with magnets or alternatively another attachment mechanism. Preferably, infrared communication means are used to avoid having to connect any wires. The therapeutical training system may register whether it is placed horizontally or vertically, and may by itself make the software exercises behave accordingly.

Additionally, a plurality of therapeutical training systems may be put together in a group and communicate with each other wireless. For instance, an exercise may be running distributed on a group of therapeutical training systems on the floor and a group of therapeutical training systems on the wall, demanding the user to interact physically with both the floor and the wall. A master device or a personal computer may be used for communication between the therapeutical training systems.

The special features of the currently preferred embodiment of the invention include the modularity, the possibility for users to modify the physical shape, the easy setup, the possibility of exclusion of an external host computer, the self-contained energy source, the wireless communication (local and global), and the individual exercises.

Additionally, the therapeutic therapy system may include means of logging response signals from the force sensor on a memory unit and displaying the response signals or a result derived from the response signals on a display unit, monitor, personal computer or by means or light and/or sound signals. The memory unit may preferably be a RAM, hard disk or CD/DVD unit. The memory unit may be communicating with the therapeutic training device and/or the master device. The memory unit may alternatively be a part of the therapeutic training device and/or the master device.

The present invention also relates to a method of performing a physical therapy on a patient or person by providing the therapeutic training system as described above, loading the software comprising an exercise program on the therapeutic training system, the exercise program comprising a series of predefined exercises, wherein each exercise comprises at least the following steps: instructing the patient by activating the light source and/or sound source of a specific therapeutic training device to apply a force onto the central part of the specific therapeutic therapy devices, and logging the response signal of the force sensor of the specific therapeutic training device.

The word patient should in this context be interpreted in its broadest sense and not limit the users to therapeutical users. Thus, the word patient also includes all possible professional and leisure users of the therapeutical training system such as for example sports trainees, gamers and the like.

It is further evident that numerous variations of the exercise program described in the method above may be realized. It follows a comprehensive but not limiting description of alternative methods according to the present invention:

The method of performing a physical therapy as described above, wherein the exercise program comprises a precision game, wherein an object is used for applying a force on the central part of the specific therapeutic therapy device, the object being for example a football, a soccer ball, a basketball, a tennis ball or a handball.

The method of performing a physical therapy as described above, wherein the exercise program comprises a balance game, wherein the therapeutic training system is located in a horizontal position preferably on a floor and the patient is instructed by the light sources and/or sound sources to walk according to a specific path on the therapeutical therapy system and thereby sequentially applies a force onto the central part of a plurality of the therapeutical therapy devices.

The method of performing a physical therapy as described above, wherein the exercise program comprises a musical game, wherein the therapeutic training devices each trigger a different music sequence, allowing e.g. a music composer to compose a concert or interact with a music album by applying a force onto the central part of a plurality of the therapeutical therapy devices.

The method of performing a physical therapy as described above, wherein the exercise program comprises a memory game, wherein the patient must memorize a sequence of light or sound signals and subsequently apply a force onto the central part of a plurality of the therapeutical therapy devices according to the sequence.

The method of performing a physical therapy as described above, wherein the exercise program comprises a dancing game, wherein the therapeutic training system shows a light sequence and plays a music sequence and the patient moves his/her feet to apply a force onto the central part of the therapeutic training device in a sequence according to the light sequence and the music.

The method of performing a physical therapy as described above, wherein the exercise program comprises a color game, wherein each color is representing a specified body part, a therapeutical training device showing a randomly selected color and the patient is applying a force onto the central part of the therapeutic training device using the designated body part.

The method of performing a physical therapy as described above, wherein the exercise program comprises a multiplayer game, wherein a plurality of patients are interacting with one or more therapeutic training systems, thereby the number of therapeutical training devices is at least the same number as the number of patients.

BRIEF DESCRIPTION OF THE DRAWINGS

FIGS. 10*a*1, 10*a*2 and 10*b* are charts of component parts.

DETAILED DESCRIPTION OF THE PREFERRED EMBODIMENTS

A detailed description of the figures of a presently preferred embodiment of the invention follows below.

Figure 1:
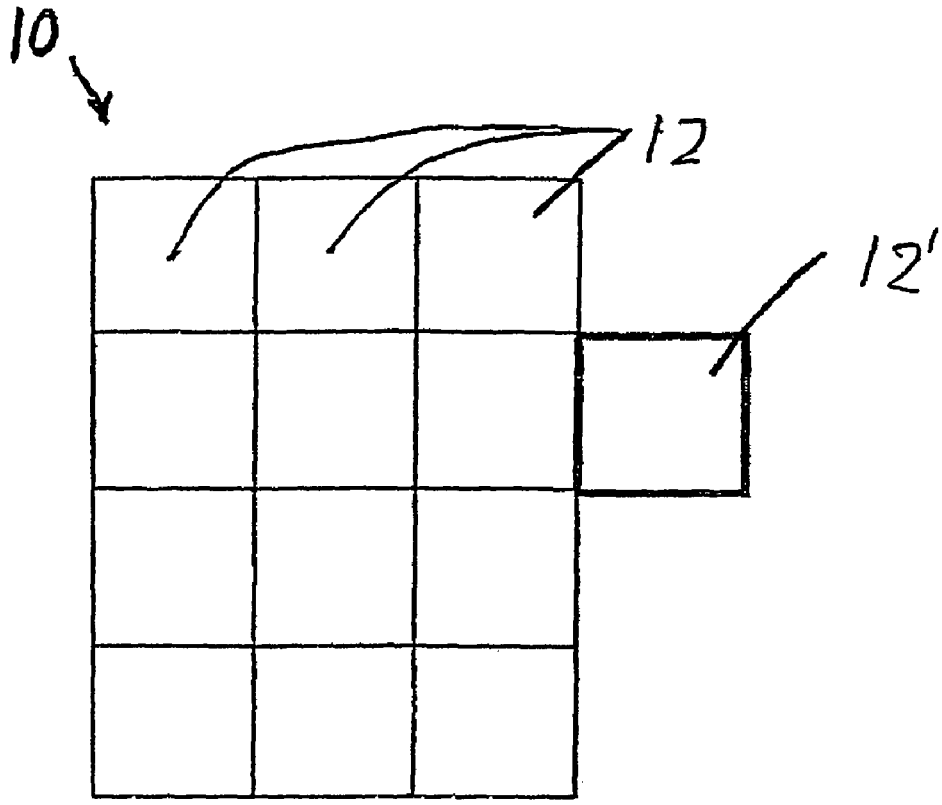
FIG. 1 illustrates a plurality of therapeutical training devices.

FIG. 1 shows a 2D view of a therapeutical training system (10) according to the invention. The therapeutical training system (10) comprises a number of therapeutical training devices (12) of quadratic shape oriented side-by-side forming a planar and flat structure. Each therapeutical training device (12) is oriented in a specific orientation juxtaposed to at least one other therapeutical training device (12) and has a user interface oriented in a certain direction towards the user. The therapeutical training device (12) further has communicating features for communicating with other therapeutical training devices (12). The master device (12') has all the features and abilities of a therapeutical training device (12) and additional features, which will be described in detail later. The shown embodiment of the therapy system (10) includes 12 therapeutical training devices (12) and one master device (12'). The number of master devices (12') must be one, whereas the number of therapeutical training devices (12) may vary.

Figure 2:
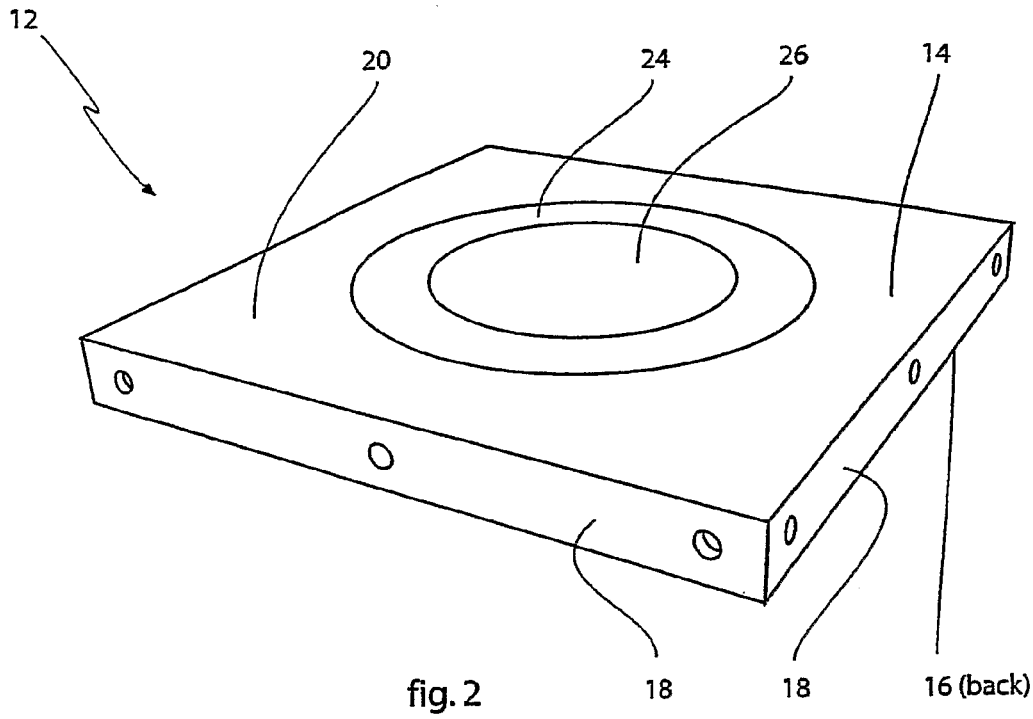
FIG. 2 illustrates a single therapeutical training device.

FIG. 2 shows a 3D view of a therapeutical training device (12) having a shallow and quadratic casing (20). The casing (20) is preferably moulded in a plastic material, such as for example polyurethane. The casing (20) further encompasses a quadratic front surface (14), a quadratic back surface (16) opposite the front surface (14) and four shallow rectangular side surfaces (18). The top surface (14) comprises a user interface having a centrally located circular cover (26) and an outer ring shaped transparent plate (24) surrounding a circular cover (26). The transparent plate (24) is preferably made of a robust plastic material such as Plexiglas and is fixed onto the casing. The circular cover (26) is preferably made of a robust plastic material and is flexible in its position. With flexible is in this context meant that the circular cover (26) either may be placed loosely in the transparent plate (24) permitting the circular cover (26) to be moved a certain distance into the casing (20) or the circular cover (26) being fixated to the casing (20) but soft and easily stretchable and able to protrude a certain distance into the casing when applying a force onto the circular cover (26).

Figure 3:
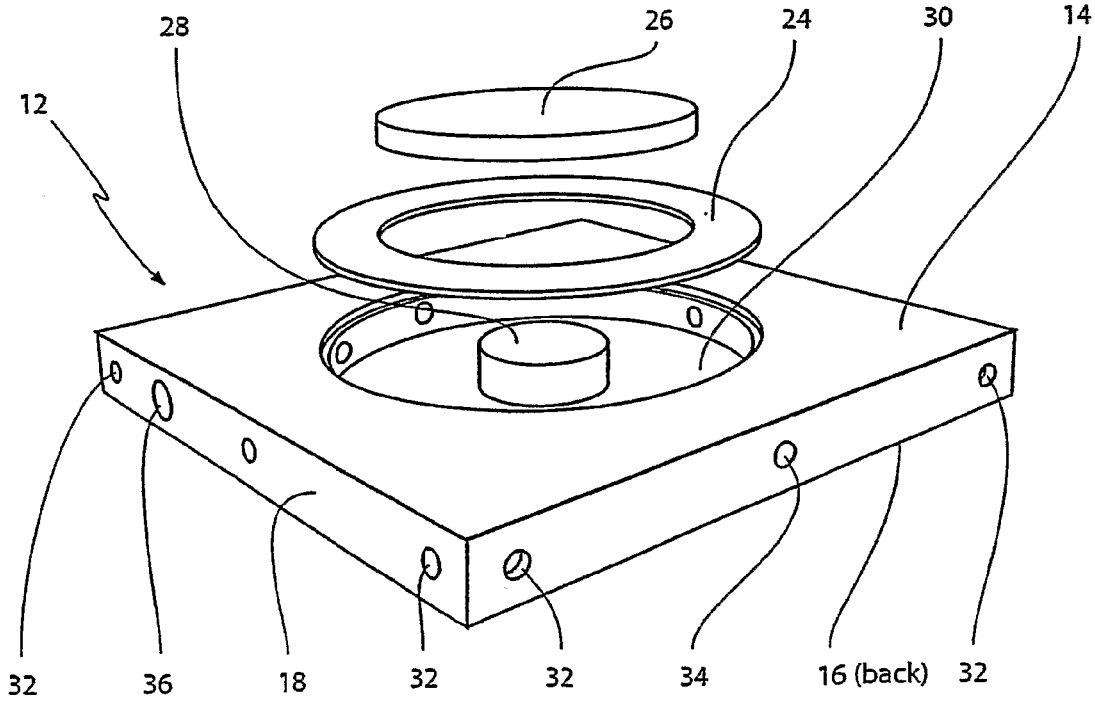
FIG. 3 illustrates an exploded view of a single therapeutical training device.

FIG. 3 shows a 3D exploded view of a therapeutical training device (12). The top surface (14) comprises a centrally located circular cavity (30). The cavity (30) comprises a centrally located raised platform (28) protruding a distance less than the depth of the cavity. Between the raised platform (28) and the circular cover (26) a force sensitive resistor (FSR, not shown) is located sensing the force applied from the outside onto the circular cover (26). The circular cavity (30) further comprises a circular printed circuit board (PCB, not shown). Each of the four sides (18) of the therapeutical training device (12) comprises two permanent magnets (32) oriented in view of polarity in such a way that attachment to other therapeutical training devices (12) is permitted. The strength of the permanent magnets (32) should be chosen to allow simple attachment and detachment by use of hand force, and still provide sufficient strength to hold the therapeutical training devices (12) fixated and clustered during use as a therapeutical training system (10). Electro magnets may in an alternative embodiment replace the permanent magnets. Each side (18) of the therapeutical training device (12) further comprises a centrally located communication port (34) forming a tubular channel extending from the outside into the circular cavity (30) housing the PCB. The communication port (34) preferably uses IR (infrared) communication means for exchange of information with other therapeutical training devices (12). One of the sides of the therapeutical training device (12) further comprises a battery charging port (36), used for connecting a battery charger to charge the internal batteries (not shown) located on the PCB (not shown).

Figure 4A:
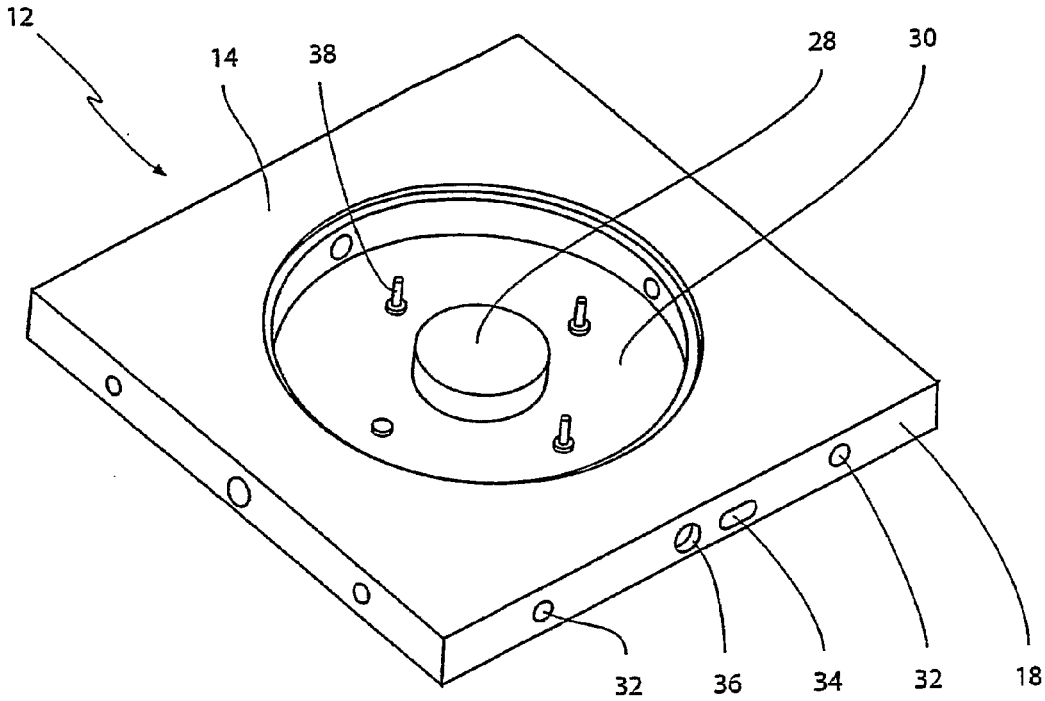
FIG. 4*a* is a 3D view of a front of a single therapeutical training device.

FIG. 4*a* shows a different 3D view of the front surface (14) of a therapeutical training device (12). The circular cavity (30) is provided with four fixation studs (38) for fixating the PCB (not shown) inside the circular cavity (30).

Figure 4B:
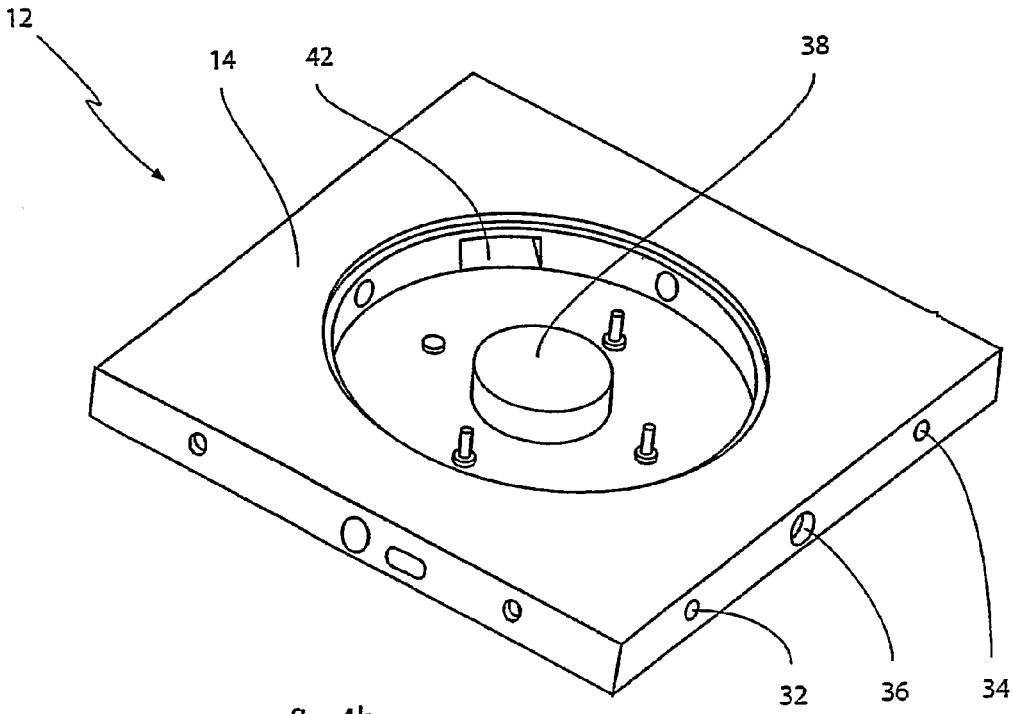
FIG. 4*b* is a different 3D view of a front of a single therapeutical training device.

FIG. 4*b* shows a different 3D view of the front surface (14) of a therapeutical training device (12). The circular cavity (30) is provided with a data communication port (42) for communicating to an external PC (personal computer). The data communication port (42) comprises a JTAG programming plug used for attaching a programming cable allowing the PCB to be configured using e.g. an external PC.

Figure 4C:
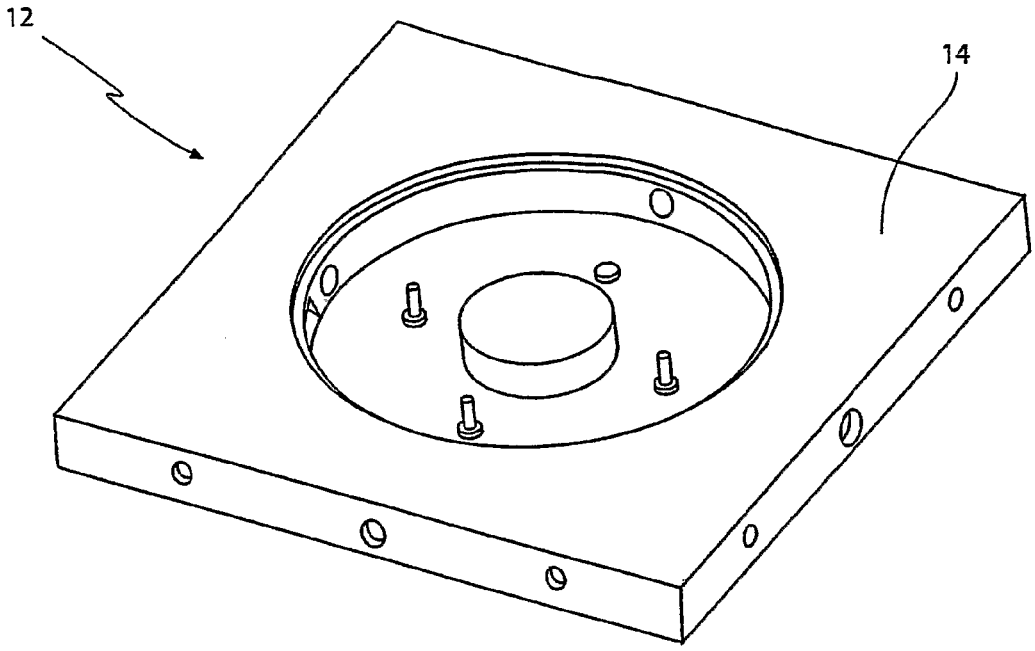
FIG. 4*c* is a different 3D view of a front of a single therapeutical training device.

FIG. 4*c* shows a different 3D view of the front surface (14) of a therapeutical training device (12).

Figure 4D:
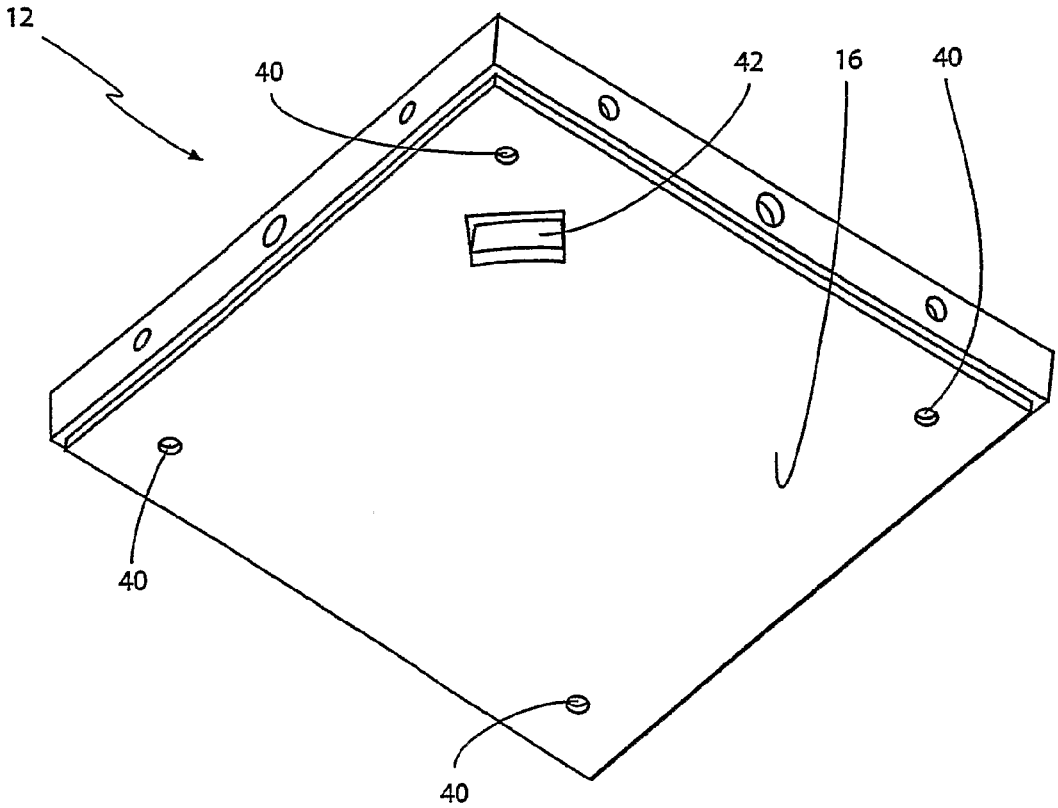
FIG. 4*d* is a rear view of a single therapeutical training device.
Figure 5C:
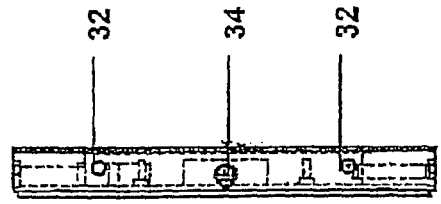
FIGS. 5*a*-5*d* illustrate a transparent view of a single therapeutical training device from different angles.
Figure 5D:
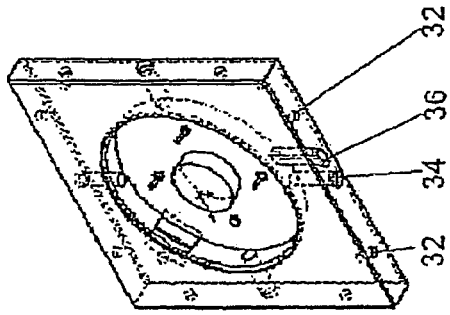
Figure 5A:
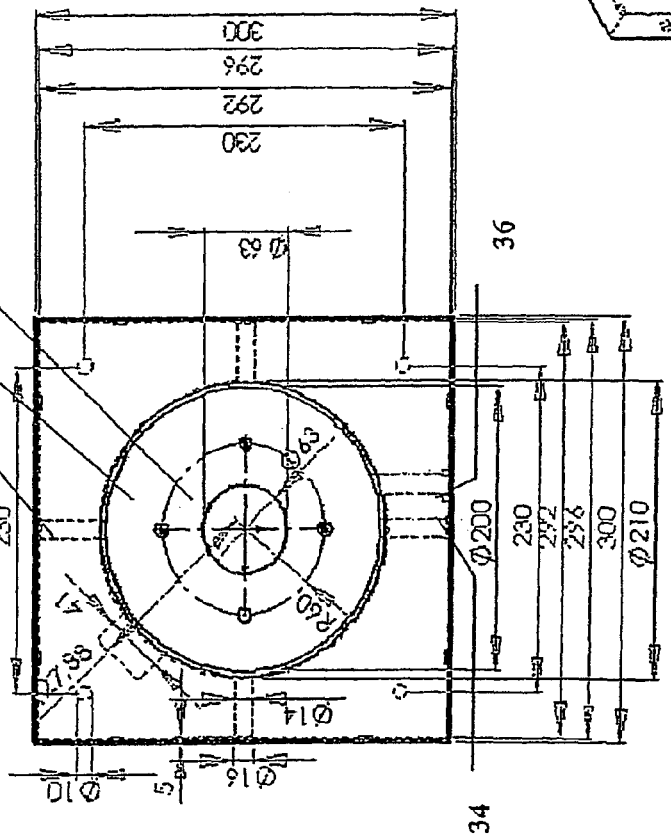
Figure 5B:
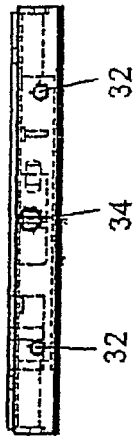
Figures 6A, 6B:
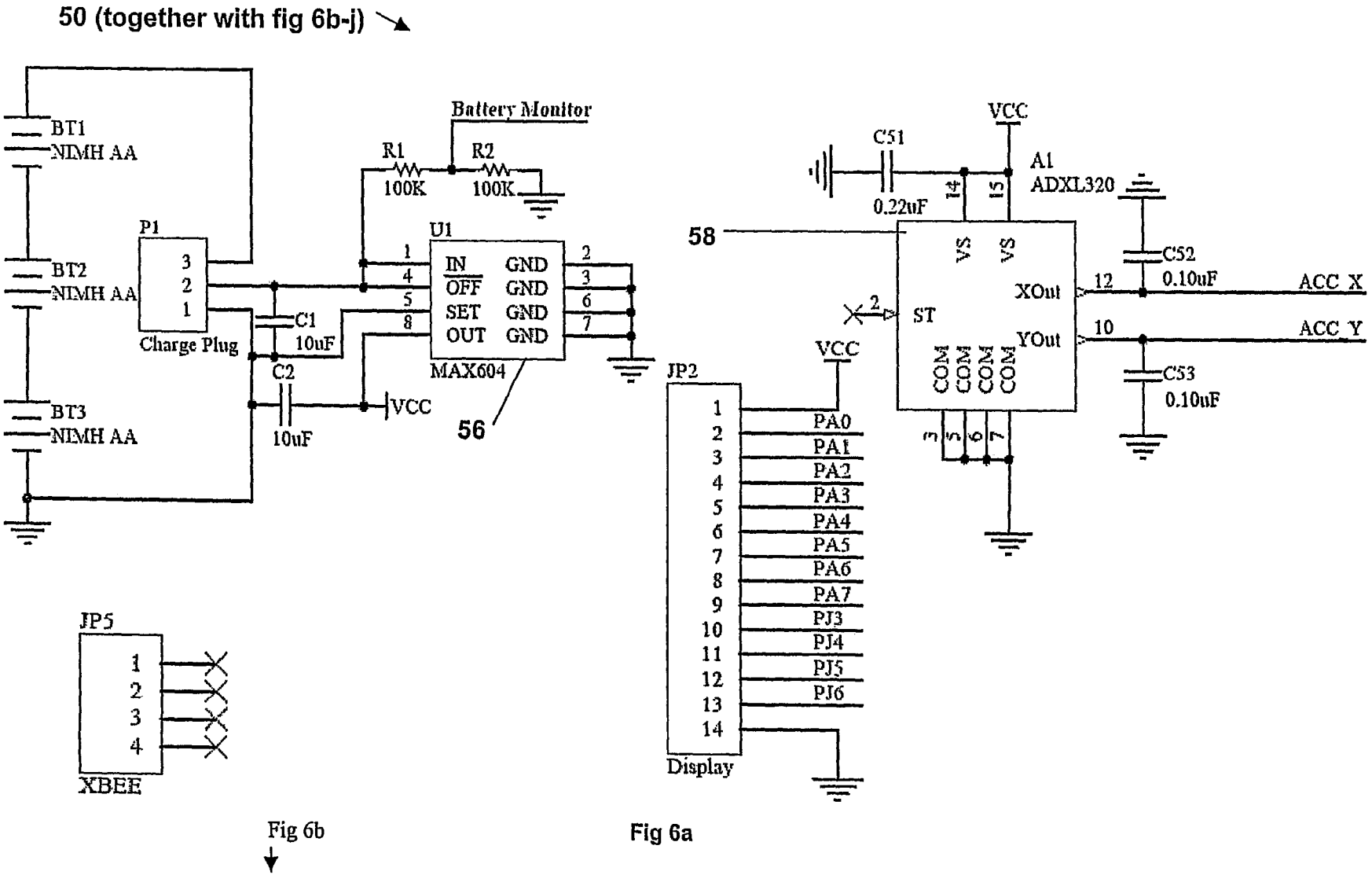
FIGS. 6*a*-6*j* illustrate a flow chart of a printed circuit board of a single therapeutical training device.
Figure 6B:
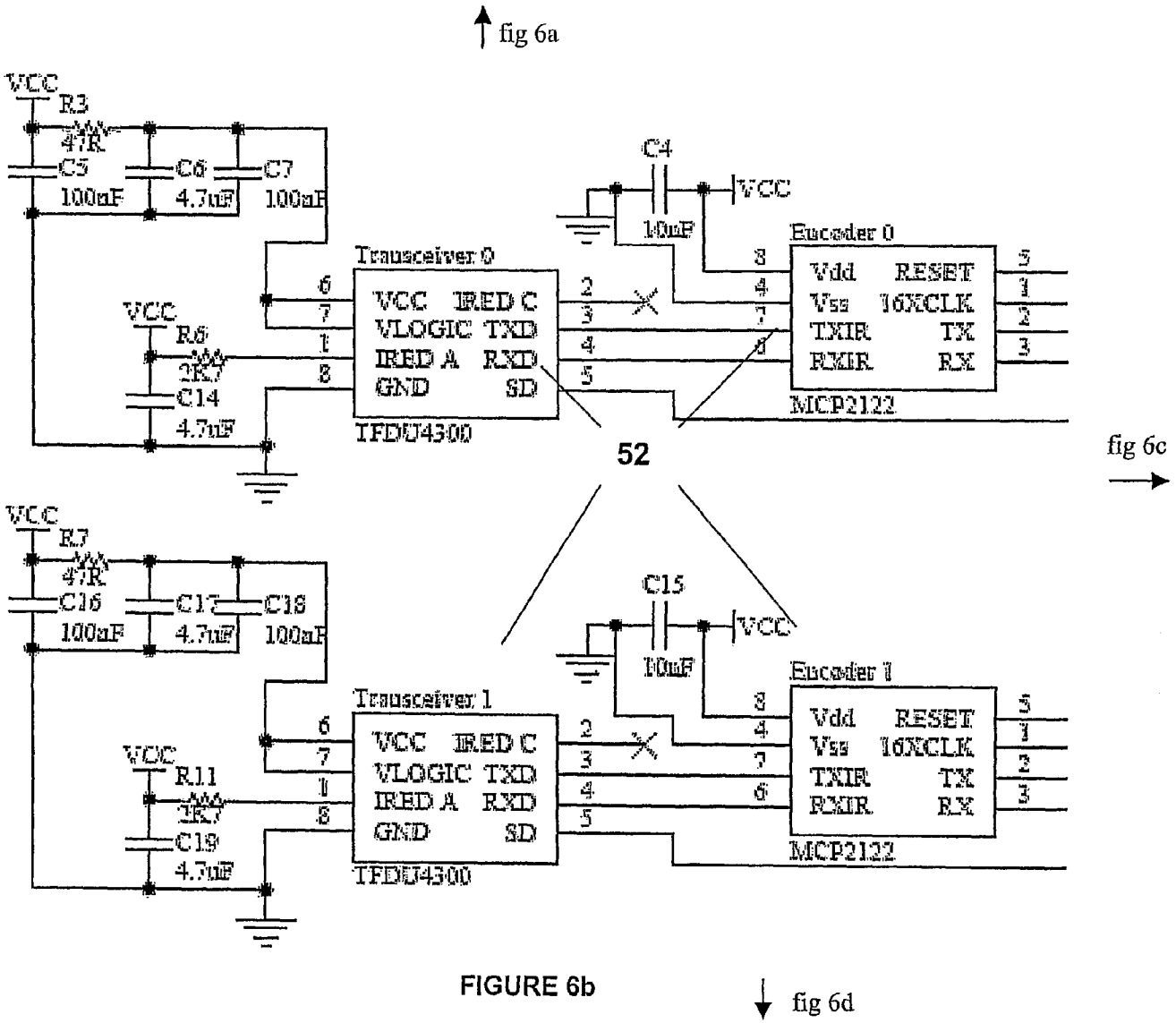
Figure 6C:
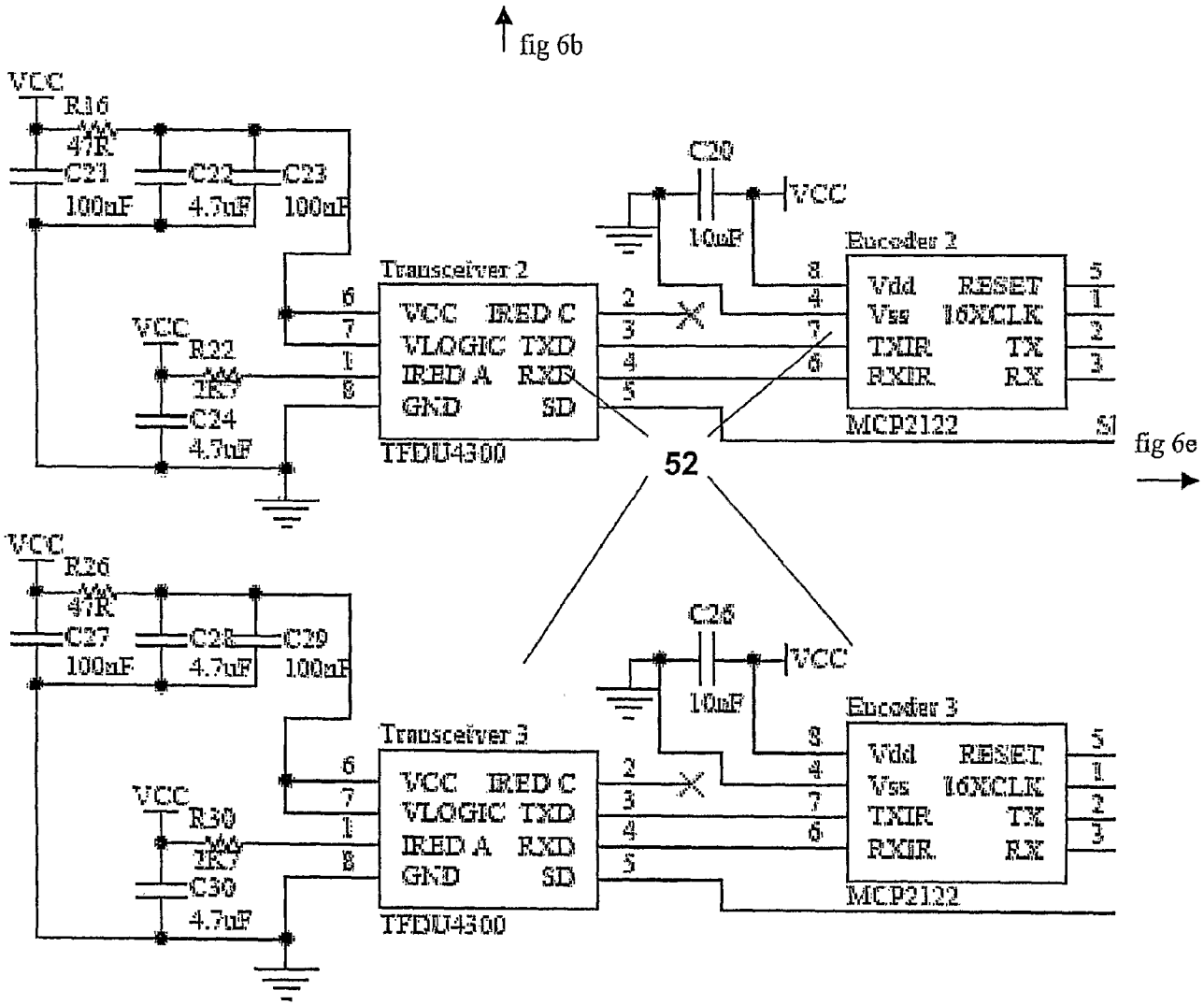
Figure 6D:
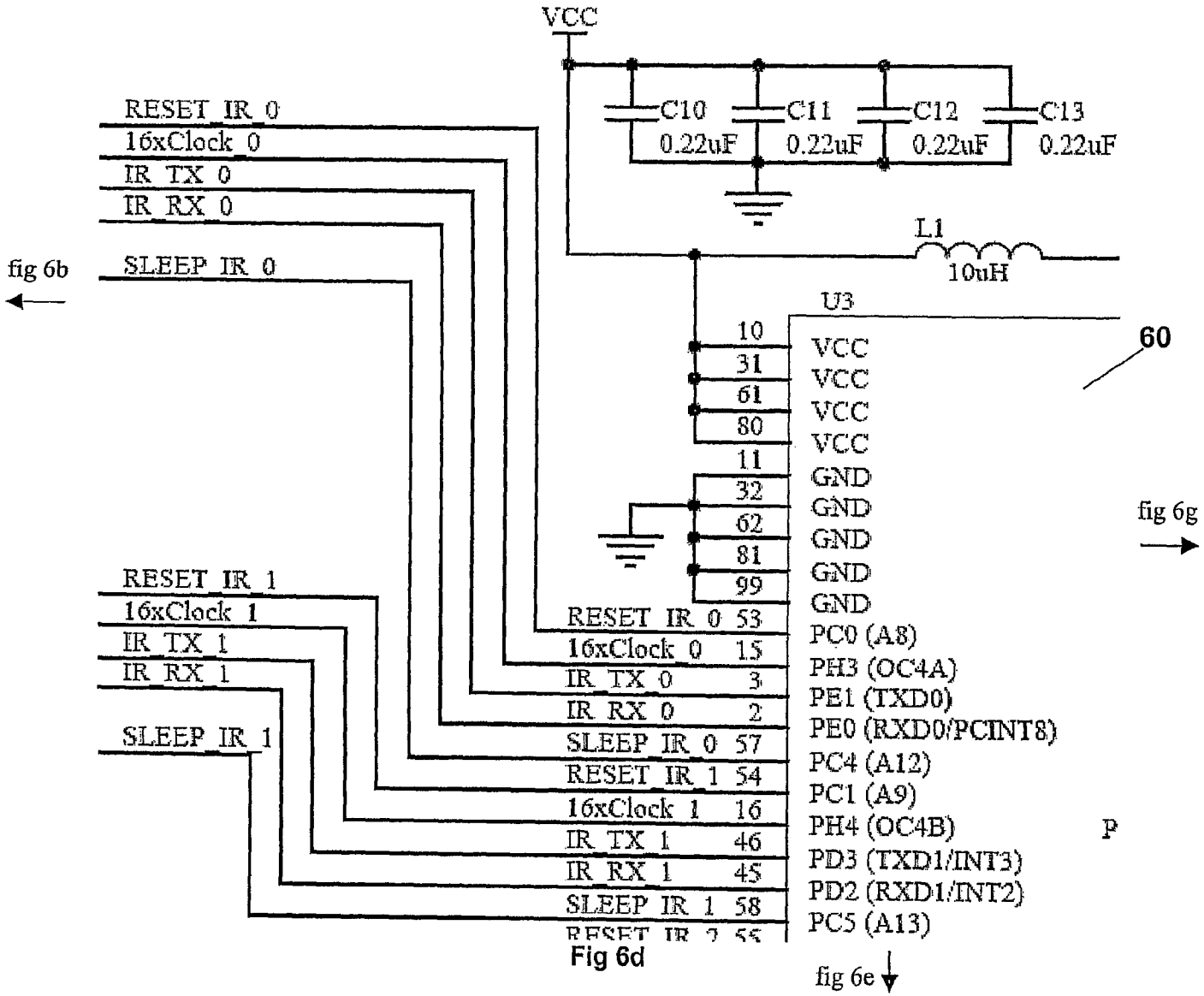
Figure 6E:
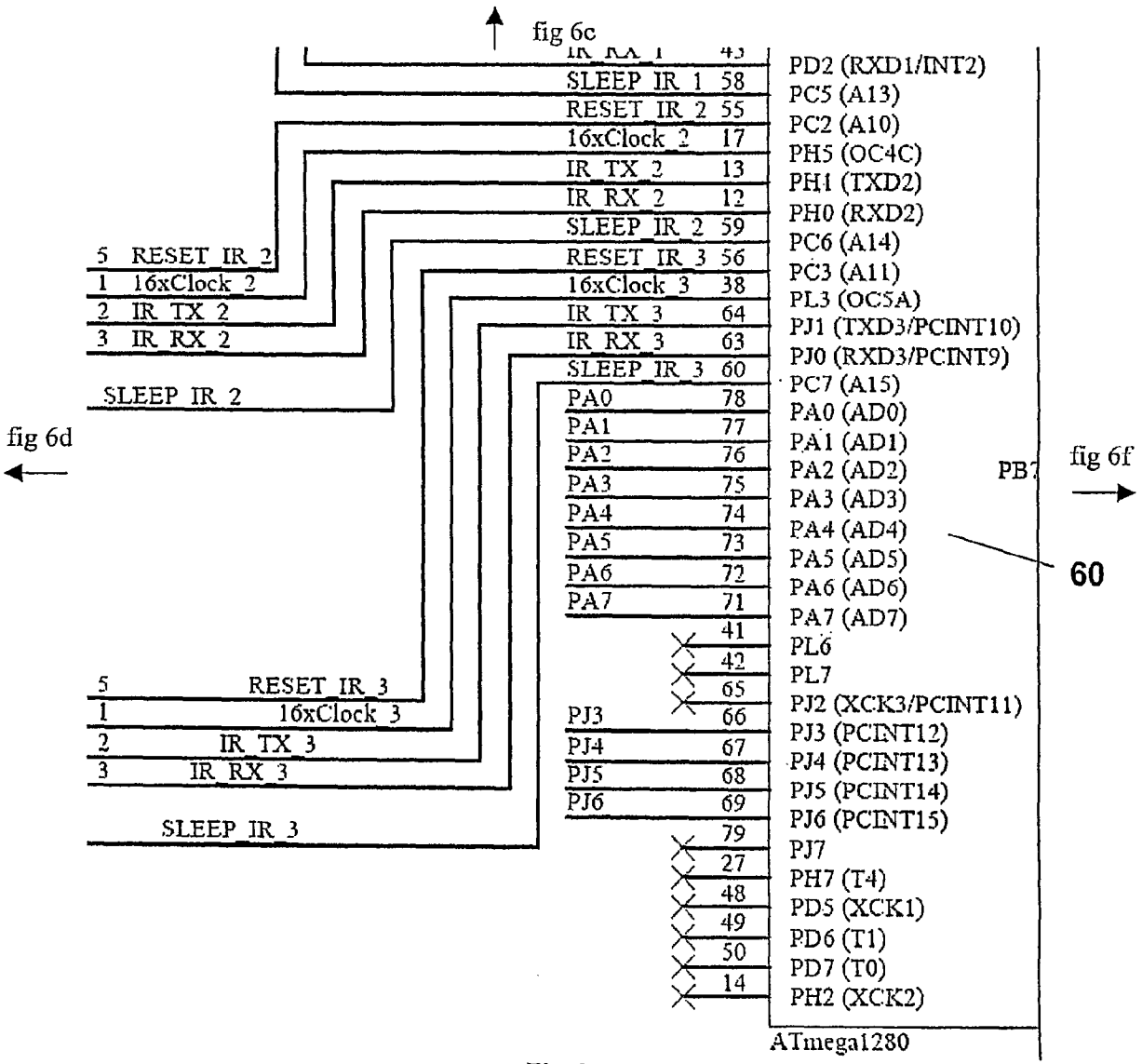
Figure 6F:
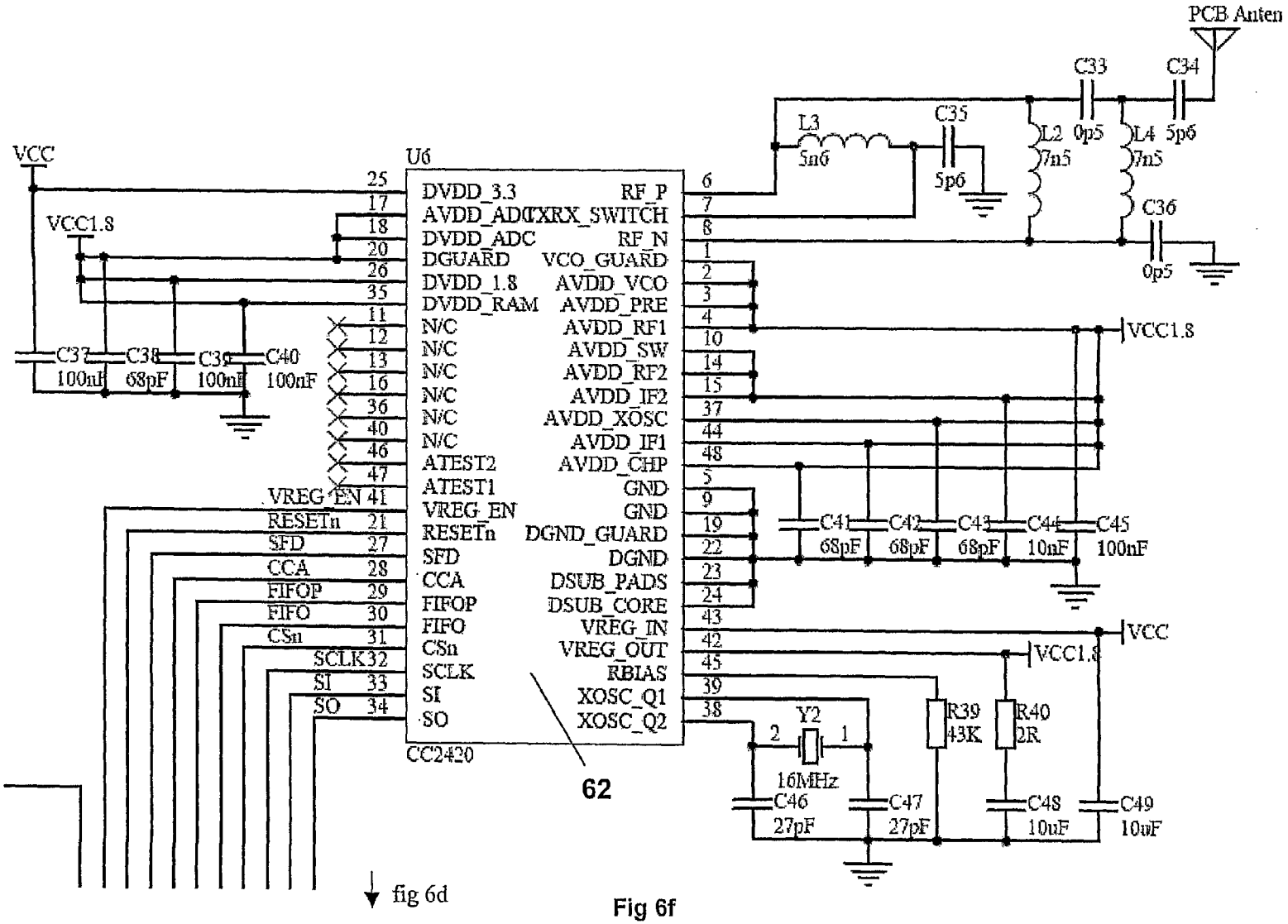
Figure 6G:
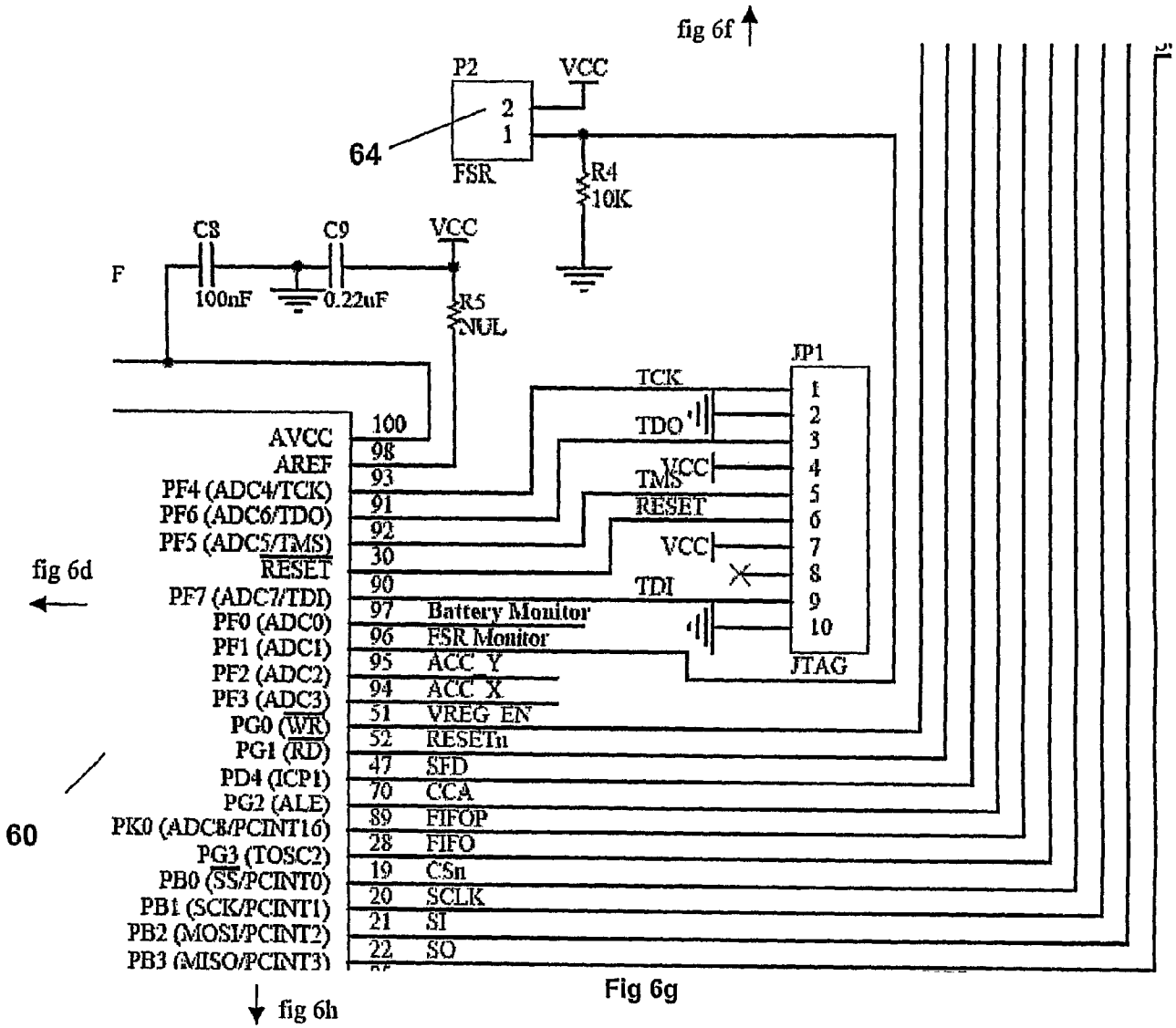
Figure 6H:
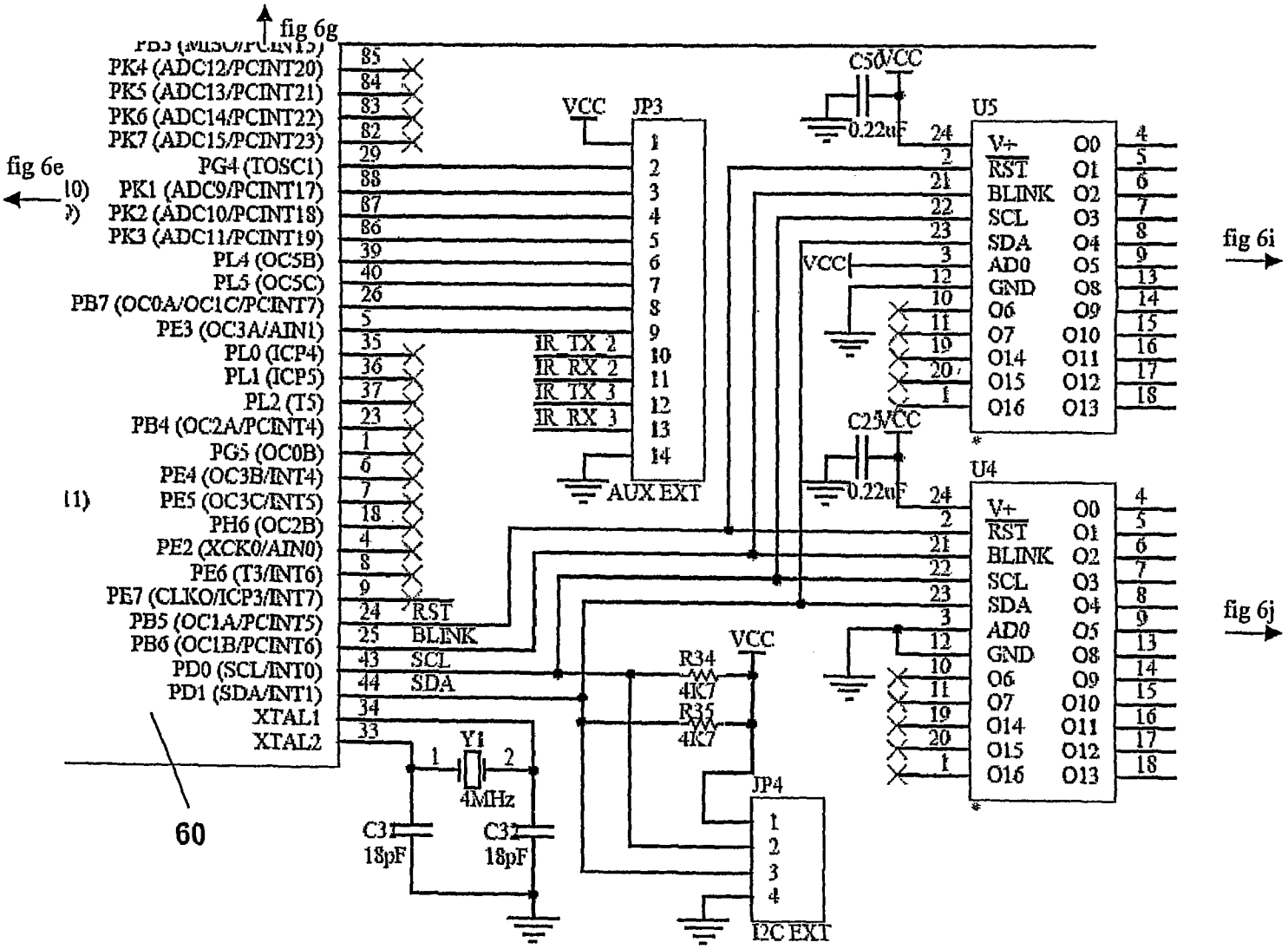
Figure 6I:
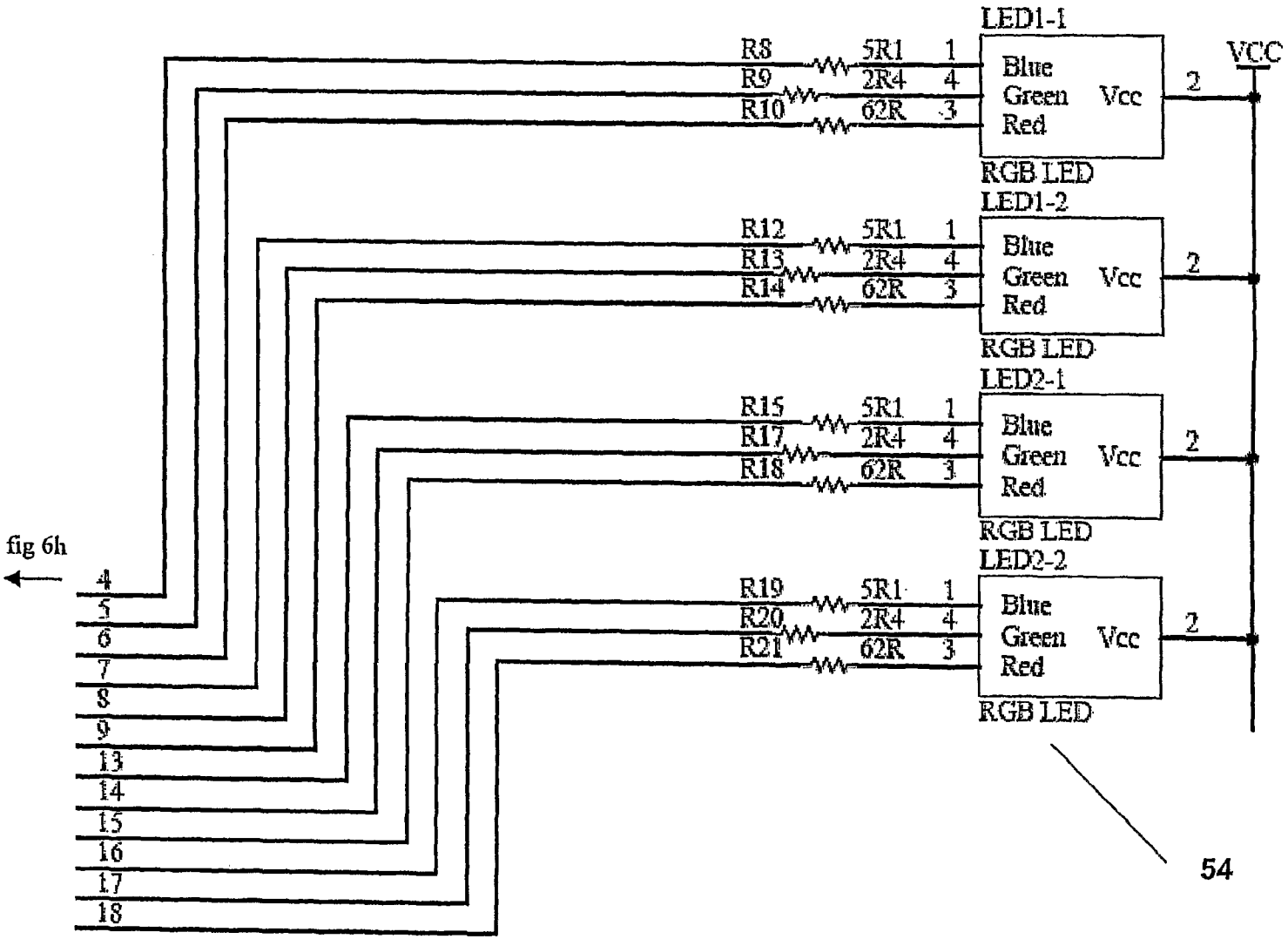
Figure 6J:
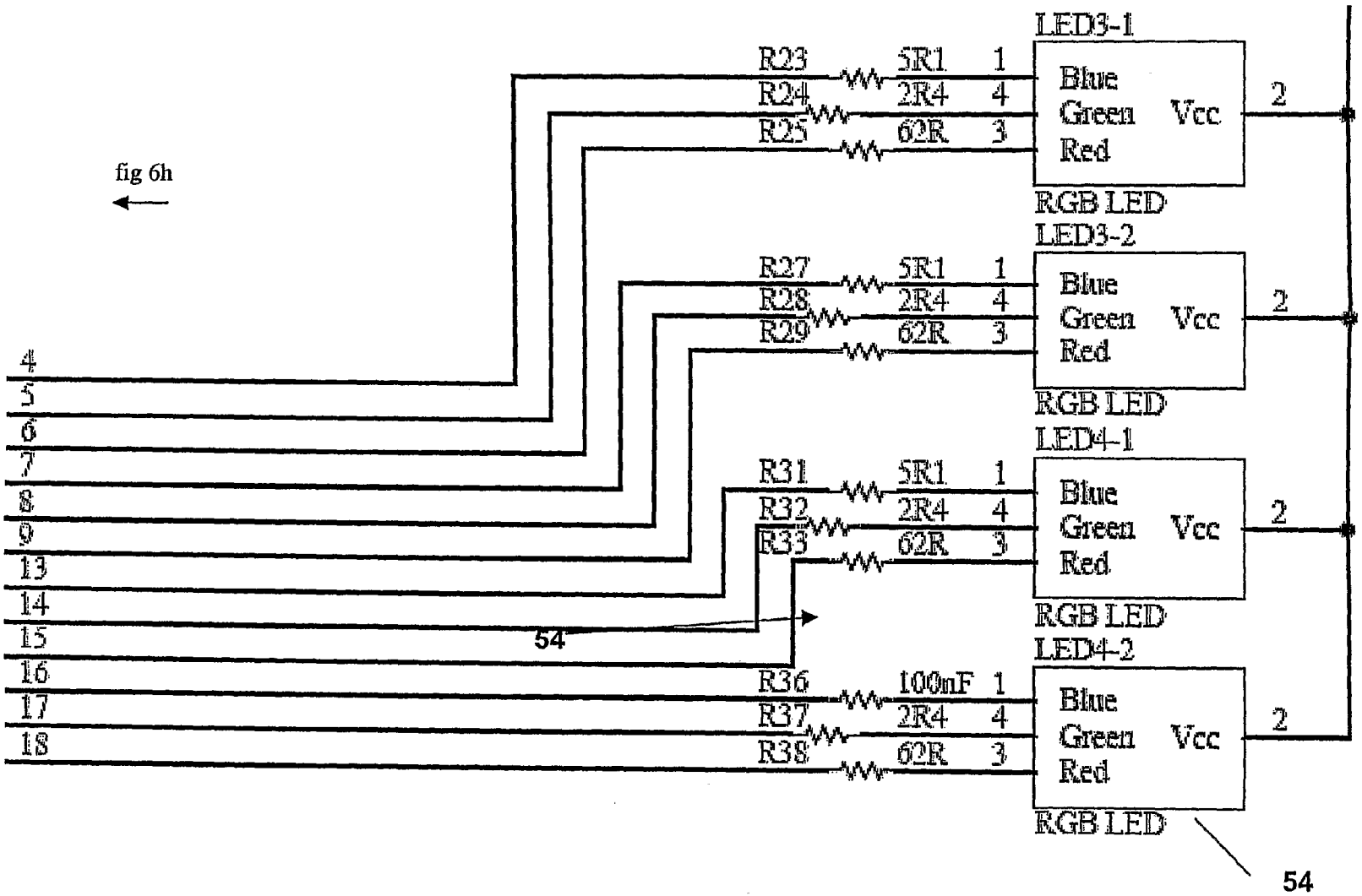

FIG. 4*d* shows a different 3D view of the back surface (16) of a therapeutical training device (12). The back surface (16) comprises four wall fixation magnets (40) for use when the therapy system (10) is used vertically mounted onto e.g. a wall. The back surface (16) further comprises the outside end of the data communication port (42)

FIGS. 5*a*-5*d* show a 3D transparent view of a therapeutical training device (12) from a variety of angles.

FIGS. 6*a*-6*j* show a flow chart view of a printed circuit board PCB (50) of a device. In the centre of the PCB (50) the microprocessor (60) can be found. The ATmega 1280 microprocessor (60) is used for controlling all the other components and for running various kind of software such as games. Four IR communication units (52) communicate to the microprocessor (60) and further detects if any other device is assembled in any of the four neighbouring positions and if such neighbouring device or devices are present communicating using infrared light to the neighbouring devices. Each IR communication unit (52) comprise a separate encoder and transceiver. Further connected to the microprocessor are eight LED (light emitting diode) units (54). The LED unit (54) each comprise three LED:s of different colors (blue, red and green). The battery unit (56) holds the three NIMH rechargeable batteries and includes a circuitry for monitoring the charge level of the batteries as well as controlling charging and discharging of the batteries. Low battery level is detected by the battery unit (56) and indicated to the user by the LED units (54). The user can recharge the batteries by simply connecting a separate charger unit (not shown) to the battery charging port (36), which in turn is connected to the battery unit (56). The time needed to fully charge the discharged batteries is 16-18 hours. For avoid unnecessary battery wear, the PCB (50) will power down if the therapeutical training device (12) is left unused for more than 5 minutes or if the therapeutical training device (12) is removed from the therapy system (10). The 2D accelerometer (58) detects horizontal or vertical placement of the device. Additionally, a wireless communication unit (62) and a force sensitive resistor (64) are connected to the microprocessor (60). The FSR preferably has a limiter, thus not reporting very low forces and limiting very high forces. The FSR may be analogue or digital.

Figure 7:
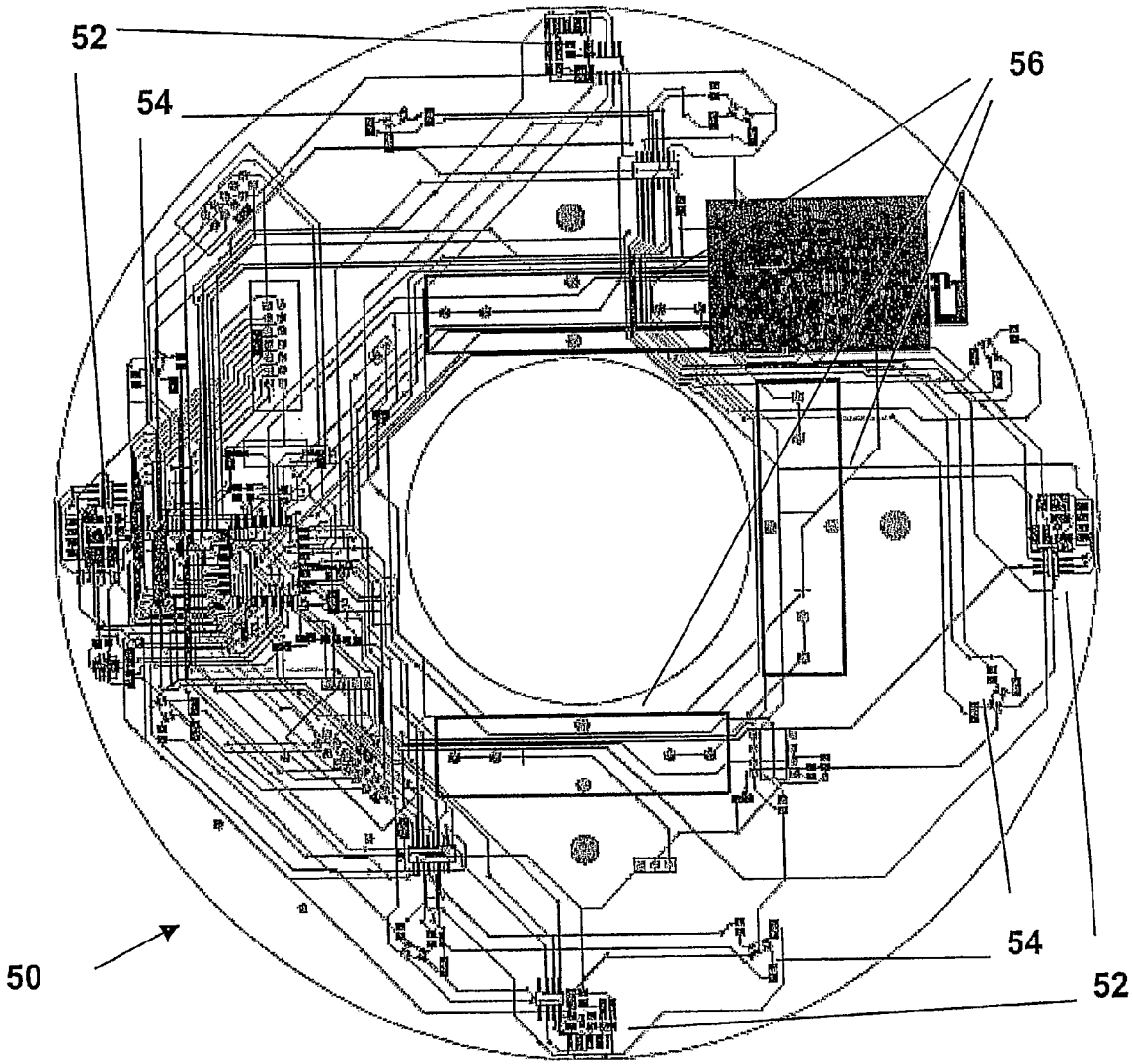
FIG. 7 is a layout of a circular printed circuit board.
Figure 8A:
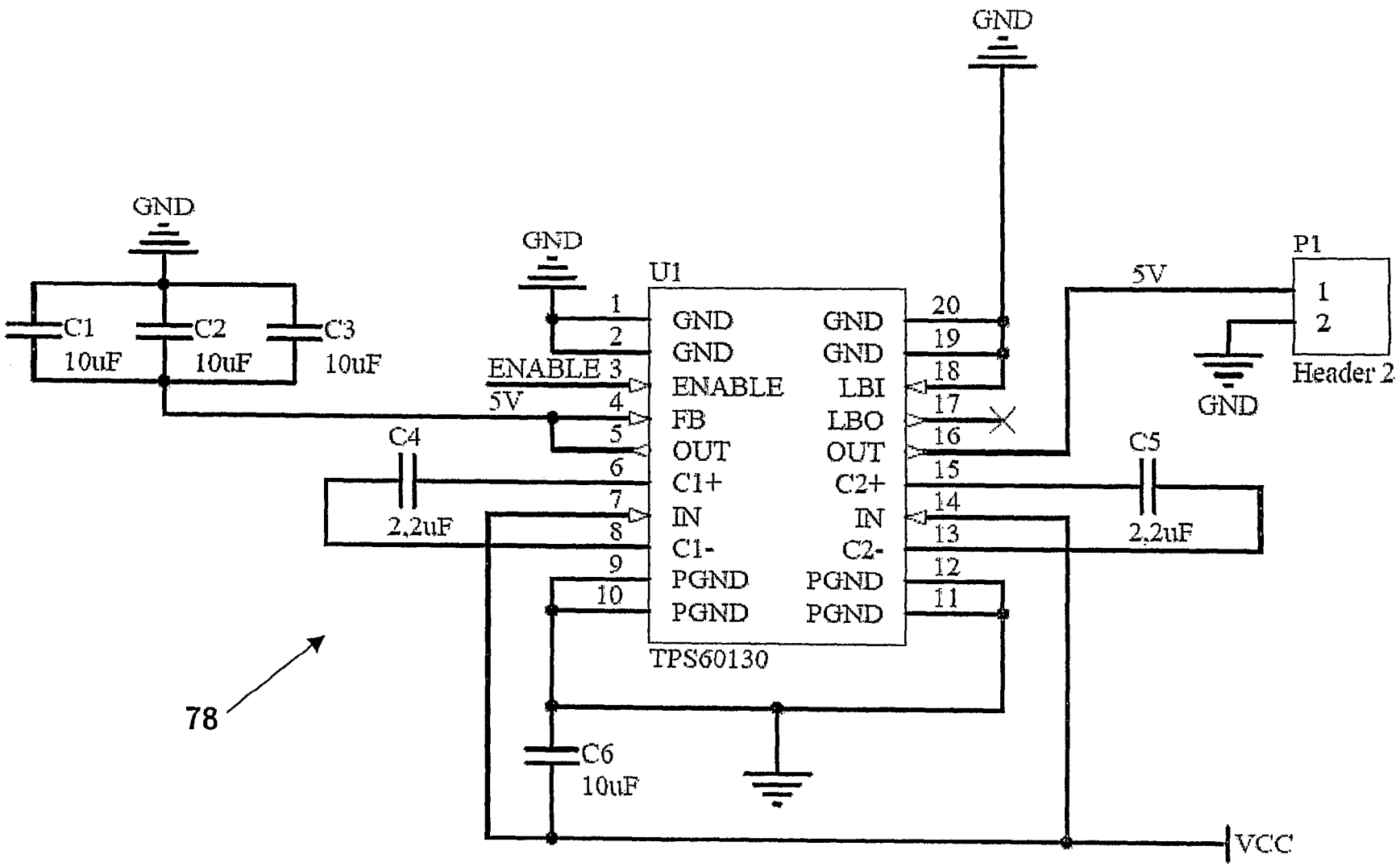
FIGS. 8*a*-8*d* illustrate a flow chart of a PLB add-on chip.
Figure 8B:
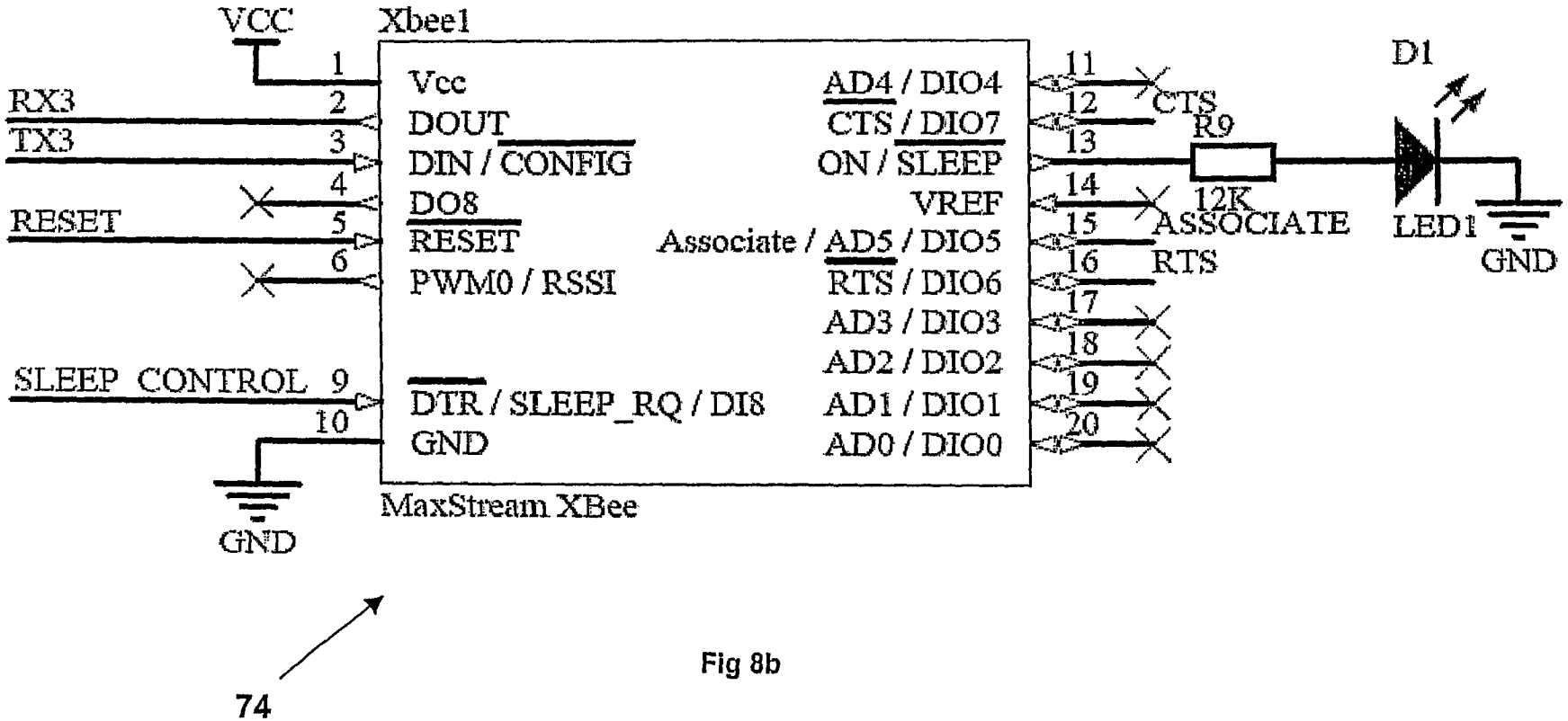
Figure 8C:
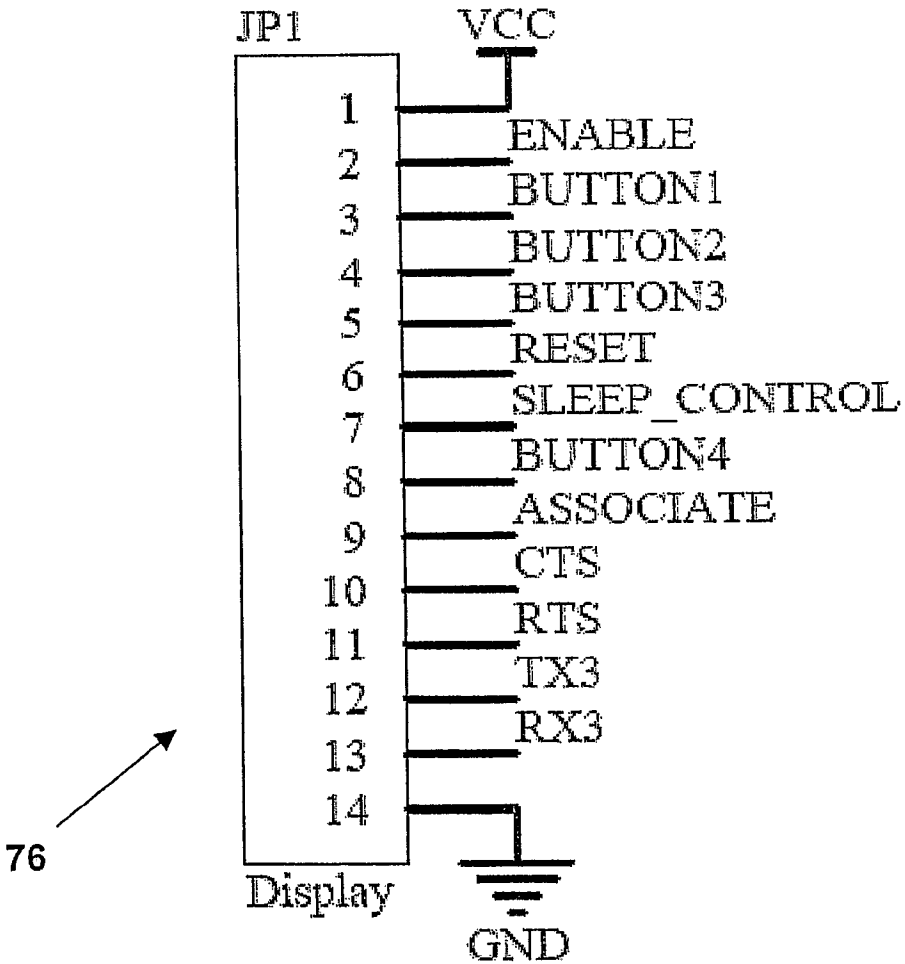
Figure 8D:
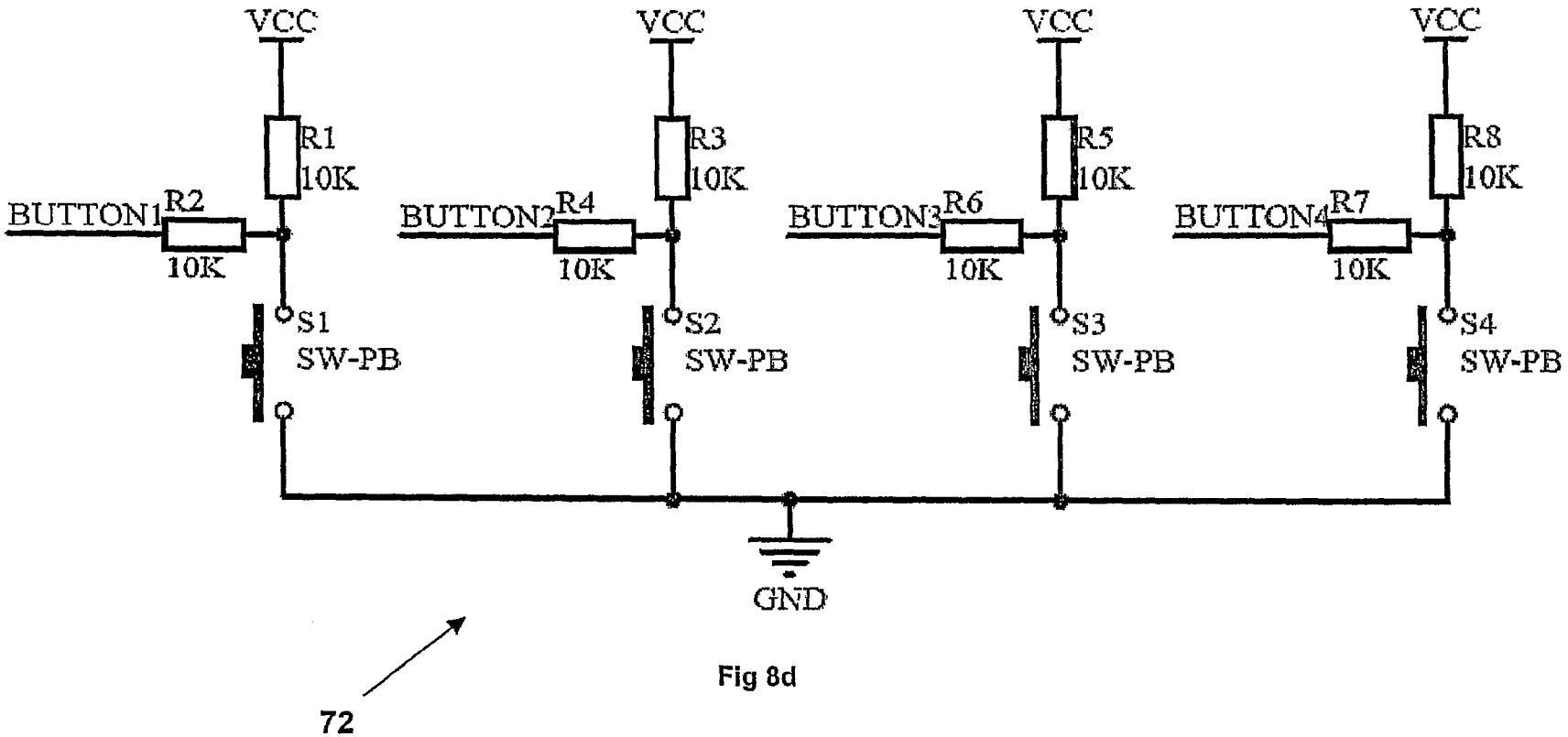

FIG. 7 shows a physical layout view of a circular printed circuit board PCB (50) designed to be fitted in the circular cavity (30). The four IR communication units (52) are located close to the edge of the PCB (50) separated by 90 degrees in such a way that each IR communication unit (52) match a corresponding communication port (34) at each side surface (16) and permit a direct line-of-sight to the communication port and IR communication unit of a connected neighbouring device. The word match should in this context be understood to mean that the IR communication unit (52) should be positioned in a way to enable IR communication from a specific IR communication unit (52) through a specific communication port (34) and further through a communication port (34) of a neighbouring device to a IR communication unit (52) of a neighbouring device if such a neighbouring device is available in the present structure of the therapeutical training device (10). If such a neighbouring device is present between the communicating IR communication units and IR communication can be performed successfully, the software running on the therapeutical training system (10) will be informed about the position of the neighbouring device. If IR communication cannot be established, the software assumes no neighbouring device in the specific position. Each therapeutical training device (12) may have up to four neighbouring devices separated by 90 degrees, i.e. a neighbour to the north, south, east and west. The software running on the therapeutical training system will further be updated if any devices are added or removed from the therapeutical training device. In this context device may mean a therapeutical training device (12) as well as other devices and apparatus compatible with the hardware and software of a therapeutically training device. With IR communication should be understood both sending and receiving of IR data signals. The data signals are preferably digital coded signals, however, analogue communication may be possible as well. The eight LED units (54) should be positioned to allow light signals from the LED units (54) to penetrate the transparent plate (24) and be clearly conceived by a user. For additional clarity and aesthetic appearance the LED units (54) are preferably distributed to form a circular appearance, i.e. being separated 45 degrees in this case of using eight LED units. The battery unit (56) includes three battery holders, fitted on top of the PCB (50) for easy access and designed for AA rechargeable batteries.

FIGS. 8*a*-8*d* show a flow chart view of the PCB add-on chip (70) used in the master device (11') only. The PCB add-on chip (70) comprises a radio communication unit (74) (XBee) used by the master device to enable wireless communication with other master devices of other therapy systems. Such wireless communication may be utilized for combining two therapeutical training systems into one therapeutical training system without the need of a physical connection. Further use involves running specific software on the master device such as for example comparing results of different patient running the same exercise simultaneously or controlling the therapy system from an external PC. A display unit (76) for showing text messages and an array of buttons (72) comprising four buttons are provided on the master device (70) for direct user interaction. The buttons are used to setup the software. The charge pump (78) (TPS60130) is used to provide power to the circuitry.

Figure 9:
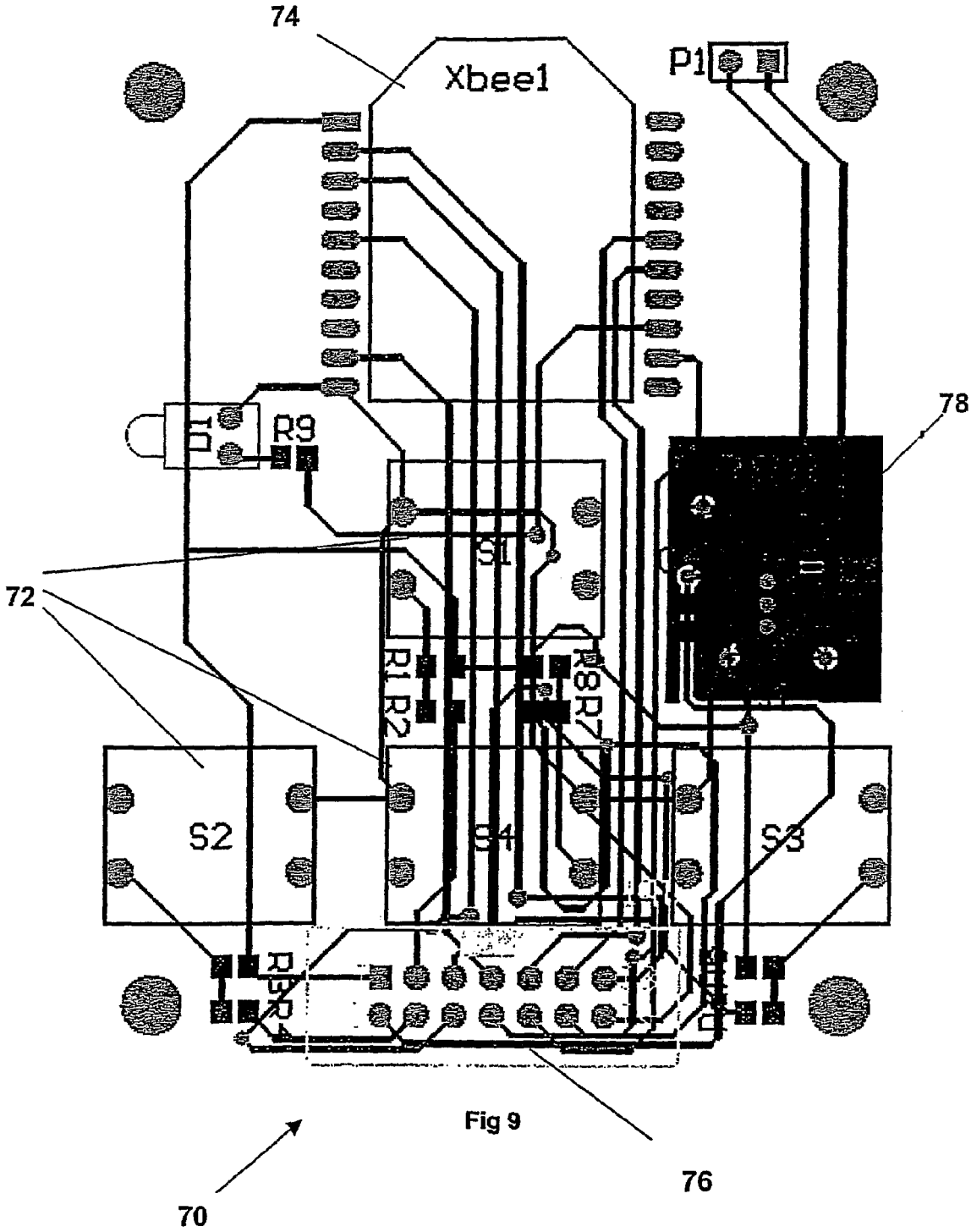
FIG. 9 illustrates a physical layout of a PLB add-on chip.

FIG. 9 shows a physical layout view of the PCB add-on chip (70). The PCB add-on chip (70) is mounted on the circular printed circuit board PCB (50). The array of buttons (72) is located such as to be operated from the outside of the device in a convenient way. The casing (20) for the master device (12') is to be modified in a way to fit the array of buttons (72) in a convenient and user-friendly way. The buttons are used to interact with the software running on the therapeutical training device. The radio communication unit (74), the display unit (76) and the charge pump (78) are located on the PCB add-on chip (70) as well.

Upon assembling the therapy system, the hardware will detect the physical structure of the therapeutical training system as described above. The software will use the information of the physical structure in setting up a therapeutical training program and evaluating the result of the patient. Below numerous embodiments of therapeutic exercises or games will be described in detail.

On the presently preferred embodiment of the invention, software can run on the ATmega 1280 microprocessors in the therapeutical training devices. If the game "Chasing Colors" is chosen on the master device, the master device will ask for number of participants (1-6), and thereafter duration of play (0.5, 1, 1.5, 2, 2.5, 5 minutes). The physical structure of the therapeutical training device is checked and then the master device asks for start: when the down button is pressed the game will start. According to the number of players, that number of colors will show up at random therapeutical training devices on the therapeutical training system. For instance, if three players are selected, there will be one therapeutical training device lighting up in red, one therapeutical training device lighting up in blue, and one therapeutical training device lighting up in yellow. When one of the therapeutical training devices which is lightened up in a specific color is pressed, the information will be sent to the master device by IR communication. The master device counts up a variable of that color with one, the color will be turned off on the current therapeutical training device and shown at another randomly selected therapeutical training device. When the selected time has passed (e.g. 1 minute), the master device will check the different color variables and the color that was pressed most times (the winner) will be shown on all therapeutical training devices (i.e. the master device sends information to the therapeutical training devices to show that color). After 10 seconds of showing the winning color, the game will restart.

Hence, in the presently preferred use of this game, the users will select the number of participants and duration of games, and then chase one color each. The user who hits most therapeutical training devices showing his/her color within the selected duration of a game will win the game, indicated by his/her color lighting up on all therapeutical training devices for 10 seconds, before a new game starts again. Users compete at the same time on one therapeutical training system and have to navigate around each other to "catch" the colors. In physiotherapy, sports and fitness training, this activity is used to create a rise in pulse amongst the participants.

For instance, if the therapeutical training system is put as a structure on the floor, the participant will be walking, running or jumping around on the therapeutical training system to hit the ones with their individual color with the feet. Alternatively, some users may choose to crawl on the therapeutical training system and hit the therapeutical training devices with their hands or knees. If the therapeutical training system is put as a structure on a wall, the users will be moving around to hit the therapeutical training devices with their hands.

The system, through the master device, checks the size of the structure using the IR communication units of each therapeutical training device in order not to allow more participants than there are therapeutical training devices available in the structure. The master device is always keeping track of number of therapeutical training devices in the structure (see description above).

The game motivates to perform physical activities because it is fun, challenging and social. Similar games with similar attributes can be made on the therapeutical training system.

In the game "Floor and Wall", the user builds two therapeutical training systems, each having a master device. The two therapeutical training systems, designated "floor"-structure and "wall"-structure are physically separated (e.g. one structure is on the floor and one structure is on a wall or alternatively they are located in two different rooms or the like. The user selects "Floor" on one master device, number of players and duration of game, in the same way as for the Chasing Colors game described above. On the other master device, the user selects "Wall". When start is indicated by pushing the down button on the "Floor" master device, the game will start on both "floor"-structure and "wall"-structure. The game is similar to the Chasing Colors game: a specific color appears either on the "floor"-structure or on the "wall"-structure. The two master devices communicate with each other by radio communication (XBee), and thereby the "floor" master device can send colors to randomly chosen therapeutical training devices either the "floor" structure or the "wall" structure. Other games using distributed therapeutical training systems that communicate with radio communication may be implemented.

In the "Simon says" game, the user only has to press start. When the game starts, one therapeutical training device will light up for 3 seconds and then turn off. The user now has to repeat by pressing on that specific therapeutical training device to make it light up. If the user presses the therapeutical training device that lighted up before, then it is correct, and all therapeutical training devices will light up in green for 3 seconds. If the user presses any other therapeutical training device, then all therapeutical training devices will light up in red, and the game will end. In the case of the correct action, the game will now show the first therapeutical training device light up again, turn off, and show a second therapeutical training device light up for 3 seconds before it turns off. The user now has to repeat the sequence on pressing the two therapeutical training devices in the order that was shown by the system. If the order that the user presses is correct, then all devices light up in green, else they light up in red and the game ends. The game continues allowing the user to try to repeat 3 lights, 4 lights, 5 lights, 6 lights, etc. until the user makes an error by pressing a therapeutical training device in the incorrect sequence. Users can compete against themselves on how long sequences they can make, and they can compete against each other on how long sequences they can make. The users can build different physical therapeutical training device structures to run the game on, in order to make the game easier or more difficult. Similar cognitive tasks, memory and imitation games can be made and, for instance, used in cognitive rehabilitation with the aspect of being both cognitive and physical games.

In the "Disco" game, a therapeutical training device lights up in a random color when it is pressed. If no therapeutical training device is pressed for 2 seconds, then all therapeutical training devices will turn off. Hence, the user can move around and continuously press the therapeutical training devices to make them change color (e.g. from red to blue to yellow to magenta to green to purple, etc.). The user may choose to play external music along with playing the game. Similar dancing games can be implemented on the therapeutical training system.

There are also one-player games such as "Stepper". The user selects the duration of game (0.5, 1, 1.5, 2, 2.5, 5 minutes). In Stepper, the master device will investigate the physical structure built by the user and find the longest rectangle with 2 therapeutical training devices on one side (i.e. 2*2, 2*3, 2*4, 2*5, . . . ). It will indicate by color on the first two that the user should place him/herself with a foot on each of these two. On the two therapeutical training devices furthest away, light will show in colors depending on the speed with which the user steps on the two therapeutical training devices where he/she is positioned. The indicator therapeutical training devices will show up in yellow, green and red in this order based on the speed on the stepping.

In the "Reach" game, the start procedure is similar to the Stepper game. Here the user has to reach out and touch the therapeutical training devices that light up. The therapeutical training devices light up in a color that may indicate that the user should use the left or right leg/arm to reach out and touch that therapeutical training device. The user can also select if the touch to activate the therapeutical training devices should be light, middle or hard (which is measured by the analogue FSR sensor). This may, for instance, allow physiotherapists and fitness trainers to select level for specific users. The "Reach" game can, for instance, be used for balance training.

In the "Ball game", the user selects the level (1, 2, 3) and the duration of the game (0.5, 1, 1.5, 2, 2.5, 5 minutes). The master device will send information to the therapeutical training devices to have a light signal traverse the therapeutical training devices in different patterns (depending on the chosen level), for instance horizontally. The user now has to hit the therapeutical training devices that light up with a ball (e.g. football or handball) from a distance chosen by the user. If the user hits the light a specific number of times (depending on the level) within the duration of the game, all therapeutical training devices will show up in blinking green, indicating that the user has won the game. A similar game may be used for e.g. racket sports.

Additional features of the preferred embodiment of the invention include a battery management system. When the battery level of a therapeutical training device is low, this will be indicated by the lights of the therapeutical training device rotating in red, while in a master device it will be written in the display. A charger can be attached to the block in the charging plug on the side of the therapeutical training devices, and the batteries will be fully recharged within 16-18 hours.

The therapeutical training system consists of a number of therapeutical training devices as described above. The therapeutical training devices can be put together to form different structures. The magnets on the sides of the therapeutical training devices makes the blocks snap and hold together. When a master device is put together with a cluster of one or more therapeutical training devices, the master block will send IR signals to the first neighbouring therapeutical training device, which will receive this IR signal as a wake-up signal and relay the signal to its own neighbours by IR communication to its North, East, South, West side. Where there is a therapeutical training device on the North, East, South or West, that (those) therapeutical training device(s) will then, at its (their) turn, relay the signal to its (their) own neighbours. And those therapeutical training devices will receive and relay the signal, and so forth. When a therapeutical training device receives a signal, it sends back a receipt, so a sending therapeutical training device can obtain knowledge about its own neighbourhood structure by keeping track of from where it receives receipts. For instance, it will have a neighbour to the North if it receives a receipt from North. The neighbourhood structure of a therapeutical training device is sent back to the device from which it received the signal, and so the different neighbourhood structures can be relayed back to the master device. Based on this information, the master device can simply build a tree structure and a map of the layout of the therapeutical training devices. This map of the physical structure, which has been built by the user, is used by the system for the different software games. The therapeutical training devices will continuously send IR signals to their North, East, South, West neighbours and receive receipts from those positions that are occupied by other blocks. If they receive signals from a position, which was not occupied at the previous time stamp, or if they do not receive signals from a position that was occupied at the previous time stamp, then the system recognizes that the structure has been changed (either by the addition of a block or the removal of a block). If this happens, the master block will re-initiate a count of blocks and their positions in order to build an updated tree structure and map of the physical layout. Hence, the recognition of changes in structure happens immediately at run-time. Therefore, it becomes possible for the user to build different structures with the therapeutical training devices, and possible for the system itself to recognize what structure the user has built.

If the therapeutical training devices are not used for 5 minutes, they will power down. Also, if a therapeutical training device is removed from the structure, it will blink three times and then power down.

With the system's knowledge of the physical structure and the continuous update of possible changes to the structure, the software games can utilize the physical structure to make games automatically become appropriate to the individual structures. The softwares (games) can adjust themselves when the structure is changed.

The buttons on the master device can be used to select games. In the prototype implementation, there are four buttons on the master device: home, left arrow, right arrow, down arrow. A small display on the master device will show text information. Initially, it will tell that the structure is being detected and print the number of therapeutical training devices found in the structure. Then the software will ask the user to select a game. By pressing the left arrow or the right arrow, the user may browse backward or forward in the list of games. The down button can be used to select one of the games. When a game is selected, the software may ask for further details from the user such as number of players, which again is selected by the arrows. Other selections to be made may include game level and duration of play.

When a game has been selected on the master device and possibly other options selected, the master device will send this information through the tree structure to all the therapeutical training devices, and the game will start.

Although the present invention has been described above with reference to specific and presently preferred embodiments of a therapy system and other devices and methods also constituting a part of the invention, it will be evident to a person having ordinary skill in the art that the therapy system including all of the devices and methods may be modified in numerous ways.

For example, it would be evident to a person skilled in the art that the invention may be performed using different energy sources, such as solar power or retrieval of energy from the physical activation of the system. Single use batteries or an external AC or DC source may replace the rechargeable batteries. The devices may be moulded in another plastic material and another transparent material could be used for the transparent ring. A flexible film or foil may be used instead of the circular cover and function as buttons or the buttons may be reinforced. The shape of the device may take other forms than quadratic and still allowing the devices to be assembled to form an overall structure (e.g. like a puzzle), and the surface may comprise grooves and be generally uneven. Additionally, light could be emitted in other patterns than a ring, such as for example a square or circle, or sound effects may replace or accompany the light. The electronic components could be substituted for other, similar components. The PCB may be chosen to have a different form in order to minimize the PCB size. The hardware may be fully or to a large extent be replaced by a personal computer. The communication between the devices may be performed by other means than IR, such as for example by radio or wire. Software features may be controlled differently such as for example by pressing on one or more of the devices or an RFID system with RFID tags may be applied for game selection. Additional software features may be implemented, such as other games. For instance, a Music game may allow the user to control MIDI signals by pressing the different therapeutical training devices and a specific sound device may be used for playing the MIDI signals. Such a sound device may include all the features of the before mentioned therapeutical training devices additionally including a sound PCB and MIDI chip add-on. Alternatively, the sounds may be played on a host computer, with the signal being sent preferably by radio communication from the master device.

LIST OF PARTS

10 Therapy system
12 Therapeutical training device
12' Master device
14 Front surface
16 Back surface
18 Side surface
20 Casing
24 Transparent plate
26 Circular cover
28 Raised platform
30 Circular cavity
32 Magnet
34 Communication port
36 Battery charging port (connector)
38 Fixation stud
40 Wall fixation magnet
42 Data communication port
50 Printed circuit board PCB
52 IR communication unit
54 LED unit
56 Battery unit
58 2D Accelerometer
60 Microprocessor
62 wireless communication unit
64 Force sensitive resistor
70 PCB add-on chip
72 Array of buttons
74 Radio communication unit
76 Display unit
78 Charge pump

The invention claimed is:

1. A method of performing a physical therapy on a patient, said method comprising the steps of providing a therapeutic training system including a plurality of shallow housings of a specific shape fastened together in a specific pattern and communicating with each other as controlled by a master device, each of the housings having a quadratic top surface, a quadratic bottom surface and four rectangular side surfaces, each said housing including an upwardly open cavity in said top surface, a flexible and transparent cover enclosing said cavity at least partially, said flexible and transparent cover having a size in a range between a size of a human fist and a size of a human foot, and defining a central part, a force sensor placed inside said cavity and communicating with said central part, said force sensor measuring a force applied on said flexible and transparent cover and generating a response signal, an indicator of one of a light source and a sound source placed inside said cavity for transmission of one light and sound through said flexible and transparent cover, a central processor placed inside each of said plurality of housings for activating said indicator in accordance with a specific software and evaluating said response signal from said force sensor in accordance with said specific software, a 2D accelerometer detecting horizontal or vertical placement of each of the plurality of housings, and a plurality of communication means located on said side surfaces controlled by said central processor for communicating with adjacent housings, loading said software including an exercise program on said therapeutic training system, said exercise program including a series of predefined exercises with each exercise including at least the following steps:

instructing said patient by activating said indicator of a specific housing to apply a force onto said central part of said specific housing, and logging said response signal of said force sensor of said specific housing.

* * * * *

UNITED STATES PATENT AND TRADEMARK OFFICE

CERTIFICATE OF CORRECTION

PATENT NO. : 8,241,183 B2
APPLICATION NO. : 12/450665
DATED : August 14, 2012
INVENTOR(S) : Hautop Lund It is certified that error appears in the above-identified patent and that said Letters Patent is hereby corrected as shown below:

On the Title page, (75) Inventor, please change the last name from "HAUTOPLUND" to --HAUTOP LUND--.

Signed and Sealed this
Twenty-fifth Day of September, 2012

David J. Kappos

David J. Kappos
*Director of the United States Patent and Trademark Office*